US011008123B2

(12) United States Patent
Kitago

(10) Patent No.: US 11,008,123 B2
(45) Date of Patent: May 18, 2021

(54) MANUAL BINDING TOOL

(71) Applicant: HellermannTyton Co., Ltd., Tokyo (JP)

(72) Inventor: Toru Kitago, Himeji (JP)

(73) Assignee: HellermannTyton Co., Ltd., Tokyo (JP)

( * ) Notice: Subject to any disclaimer, the term of this patent is extended or adjusted under 35 U.S.C. 154(b) by 93 days.

(21) Appl. No.: 16/093,414

(22) PCT Filed: Apr. 18, 2016

(86) PCT No.: PCT/JP2016/062228
§ 371 (c)(1),
(2) Date: Oct. 12, 2018

(87) PCT Pub. No.: WO2017/183073
PCT Pub. Date: Oct. 26, 2017

(65) Prior Publication Data

US 2019/0127095 A1 May 2, 2019

(51) Int. Cl.
*B65B 13/02* (2006.01)
*B65B 13/22* (2006.01)
*B65B 13/18* (2006.01)

(52) U.S. Cl.
CPC ..... *B65B 13/027* (2013.01); *B65B 13/18* (2013.01); *B65B 13/22* (2013.01)

(58) Field of Classification Search
CPC ..... B65B 13/025; B65B 13/027; B65B 13/18; B65B 13/185; B65B 13/22; B65B 13/30; B65B 13/305; B65B 13/34; B65B 13/345
(Continued)

(56) References Cited

U.S. PATENT DOCUMENTS 4,928,738 A * 5/1990 Marelin ..... B65B 13/027 140/123.6
4,947,901 A * 8/1990 Rancour ..... B65B 13/027 140/123.6

(Continued)

FOREIGN PATENT DOCUMENTS

CH 629719 A3 5/1982
CN 201077538 6/2008

(Continued)

OTHER PUBLICATIONS

English Machine Translation of WO2014024295A1: "Manual Bundling Tool" (Published: Feb. 2014) (Year: 2014).*

(Continued)

*Primary Examiner* — Shelley M Self
*Assistant Examiner* — Katie L. Parr
(74) *Attorney, Agent, or Firm* — Colby Nipper PLLC

(57) ABSTRACT

A manual binding tool has a first operating part opposite a handle unit and is capable of shifting positions relative to the tool body. A tightening mechanism pulls a second end in the lengthwise direction of the cable tie band part relative to a head part via operation of the first operating part. A holding mechanism holds the second end in the lengthwise direction of the band part pulled by the tightening mechanism to prevent a return movement. Second operating parts are provided to shift positions relative to the tool body. A fastening mechanism secures the second end of the band part in response to the operation of the second operating parts. Third operating parts are provided to shift positions relative to the tool body. A cutting mechanism cuts the second end of the band part in the lengthwise direction in response to the operation of the third operating parts.

10 Claims, 22 Drawing Sheets

(58) Field of Classification Search
USPC ..... 140/93 A, 57, 123.6; 100/29–33 PB
See application file for complete search history.

(56) References Cited

U.S. PATENT DOCUMENTS

| | | | | |
|---|---|---|---|---|
| 5,167,265 | A | 12/1992 | Sakamoto | |
| 5,205,328 | A * | 4/1993 | Johnson | B65B 13/027 140/93 A |
| 6,206,053 | B1 * | 3/2001 | Hillegonds | B65B 13/027 140/123.6 |
| 7,059,362 | B2 * | 6/2006 | Koons | B25B 23/0092 140/123.5 |
| 9,481,102 | B1 * | 11/2016 | Hojnacki | B26D 5/10 |
| 2002/0179175 | A1 * | 12/2002 | Finzo | B65B 13/305 140/93.2 |
| 2005/0005993 | A1 * | 1/2005 | Magno, Jr. | B65B 13/22 140/123.6 |
| 2005/0115629 | A1 * | 6/2005 | Bernard | B65B 13/027 140/123.5 |
| 2006/0243341 | A1 * | 11/2006 | Bernard | B65B 13/24 140/123.5 |
| 2007/0267085 | A1 * | 11/2007 | Bae | B65B 13/027 140/93.2 |
| 2008/0092981 | A1 * | 4/2008 | Hillegonds | B65B 13/027 140/93.4 |
| 2009/0121069 | A1 | 5/2009 | Dyer et al. | |
| 2015/0151862 | A1 | 6/2015 | Kitago | |
| 2015/0239588 | A1 | 8/2015 | Kitago | |
| 2017/0015449 | A1 * | 1/2017 | Marelin | B65B 13/027 |
| 2019/0210749 | A1 | 7/2019 | Kitago | |

FOREIGN PATENT DOCUMENTS

| | | |
|---|---|---|
| CN | 102642632 | 8/2012 |
| EP | 0506228 | 9/1992 |
| GB | 1395859 | 5/1975 |
| JP | 2-4614 A | 1/1990 |
| JP | H07205915 | 8/1995 |
| JP | H10152113 | 6/1998 |
| JP | 2006240695 A | 9/2006 |
| JP | 2009262965 A | 11/2009 |
| JP | 2012144257 A | 8/2012 |
| WO | 2014024295 A1 | 2/2014 |
| WO | 2014024296 A1 | 2/2014 |

OTHER PUBLICATIONS

English Abstract Translation of CH629719, published May 14, 1982.
"Extended European Search Report", EP Application No. 16899347.5, dated Nov. 11, 2019, 8 pages.
"Foreign Notice of Allowance", JP Application No. 2018-512652, dated Dec. 3, 2019, 5 pages.
"Foreign Office Action", CN Application No. 201680085764.2, dated Mar. 25, 2020, 12 pages.
"Foreign Office Action", CN Application No. 201680086856.2, dated Apr. 16, 2020, 12 pages.
"Foreign Office Action", EP Application No. 16899347.5, dated May 11, 2020, 3 pages.
"Foreign Office Action", JP Application No. 2018-512653, dated Sep. 24, 2019, 14 pages.
"Non-Final Office Action", U.S. Appl. No. 16/093,432, dated Jul. 23, 2020, 18 pages.
Pursuant to MPEP §2001.6(b) the applicant brings the following co-pending application to the Examiner's attention: U.S. Appl. No. 16/093,432.
"Foreign Office Action", EP Application No. 16899348.3, dated Nov. 12, 2020, 3 pages.
"Foreign Office Action", CN Application No. 201680085764.2, dated Dec. 2, 2020, 7 pages.
"Notice of Allowance", U.S. Appl. No. 16/093,432, dated Mar. 2, 2021, 10 pages.
"Foreign Office Action", EP Application 16899347.5, dated Mar. 5, 2021, 4 pages.

* cited by examiner

MANUAL BINDING TOOL

CROSS-REFERENCE TO RELATED APPLICATIONS

This application is a national stage application under 35 U.S.C. § 371 of PCT Application Number PCT/JP16/62228 having an international filing date of Apr. 18, 2016, which designated the United States, the entire disclosure of which is hereby incorporated herein by reference.

TECHNICAL FIELD OF THE INVENTION

The present invention relates to manual binding tools.

BACKGROUND OF THE INVENTION

Conventionally, manual binding tools used for metal binding band are known. This kind of manual binding tool is equipped with a handle and lever, a tightening mechanism that pulls a band toward a head unit after it passing through the head unit of the binding band, a fastening mechanism that fastens a leading end side of the band to a base end portion using the head unit, and a cutting mechanism that cuts the band near the head unit.

The manual binding tool is further equipped with a tightening-force adjustment mechanism that freely sets a maximum value of the tightening force using the tightening mechanism. Also, the manual binding tool is constituted to operate the tightening mechanism until the tightening force by the tightening mechanism reaches the maximum value (setting value), when the lever is rotated, and to operate the fastening and cutting mechanisms instead of the tightening mechanism when the tightening force has reached the setting value.

Stated another way, according to the manual binding tool, the action times of a pushing mechanism and the cutting mechanism are limited when the tightening force by the tightening mechanism has reached the maximum value set by the tightening-force adjustment mechanism by continuing the rotating operation of the lever. In other words, it was not possible freely to operate the pushing mechanism and the cutting mechanism for a predetermined time before or after the tightening force by the tightening mechanism reaches the maximum value.

Therefore, when the binding band is tightened loosely enough for the wire-shaped band that binds a target for binding to unravel, for example, or even if the binding band is tightened firmly enough to damage the target for binding, if the tightening force by the tightening mechanism reaches the maximum value, the pushing mechanism and the cutting mechanism will operate, so there is concern that the binding band will not be properly tightened.

SUMMARY OF THE INVENTION

An object of the present invention is to provide a manual binding tool that can execute an appropriate tightening of a binding band.

According to one aspect of the present invention, a manual binding tool is used for the binding band to bind a target for binding using a metal binding band equipped with a band-shaped band unit, and a head unit disposed at an end portion of the band unit in a length direction. The manual binding tool includes a tool body having a frame, a handle unit projecting from the frame, and a set unit continuously disposed on the frame, and formed to be able to set the head unit of the binding band. The manual binding tool also includes a first operating tool displaceably disposed on the tool body to oppose the handle unit and a tightening mechanism constituted to be able to pull another end portion side of the length direction band unit after passing through the head set in the set unit to the head unit in response to the displacement operation of the first operating tool, and a holding mechanism that holds at the tool unit the length direction other end portion side of the band unit pulled by the tightening mechanism so as not to move and return to the head unit side and The manual binding tool further includes a second operating tool displaceably disposed on the tool body and a fastening mechanism constituted to be able to fasten the length-direction other end portion side of the band unit while it is passing through the head unit set in the set unit to the length-direction other end portion using the head unit in response to the displacement operation of the second operating tool. The manual binding tool additionally includes a third operating tool displaceably disposed on the tool body and a cutting mechanism constituted to be able to cut the length direction other end portion side of the band unit after it passes through the head set in the set unit to the head unit in response to the displacement operation of the third operating tool, to separate it in the length direction of the band unit According to another aspect of the present invention, the tool body has a pistol shape and the set unit is arranged in a region that corresponds to a muzzle portion in the tool body.

According to still another aspect of the present invention, the set unit is disposed on the tool body so that the length-direction other end portion side of the band unit after it passes through the head set in the set unit is positioned at a side opposing the handle unit sandwiching the frame.

According to still another aspect of the present invention, the set unit is detachably mounted to the frame.

According to still another aspect of the present invention, the second operating tool and the third operating tool are the same operating tool.

According to still another aspect of the present invention, the second operating tool and the third operating tool each is constituted by using the first operating tool and a switching tool for switching a mechanism that operates in response to the displacement of the first operating tool, between the tightening mechanism, the fastening mechanism, and the cutting mechanism.

According to still another aspect of the present invention, wherein the switching tool is mounted to the first operating tool to be able integrally to be displaced with the first operating tool to the tool body and relatively to be able to be displaced with the first operating body, so that it can be gripped together with each of the handle unit and the first operating tool.

According to still another aspect of the present invention, comprising a mechanism that disables switching by the switching tool during displacement of the first operating tool.

According to the present invention, it is possible to provide a manual binding tool that can execute an appropriate tightening of a binding band.

BRIEF DESCRIPTION OF THE SEVERAL VIEWS OF THE DRAWING

FIG. 3A is a front view of a binding band used in the manual binding tool shown in

FIG. 1;

DETAILED DESCRIPTION OF THE INVENTION

Firstly, a constitution of a manual binding tool 1 according to one embodiment of the present invention will now be described with reference to the drawings. Also, in the description below, the direction of the arrow X in FIG. 1 denotes the front direction of the manual binding tool 1, the direction of the arrow Y denotes the upward direction of the manual binding tool 1, and the direction of the arrow Z denotes the left direction of the manual binding tool 1.

Figure 1:
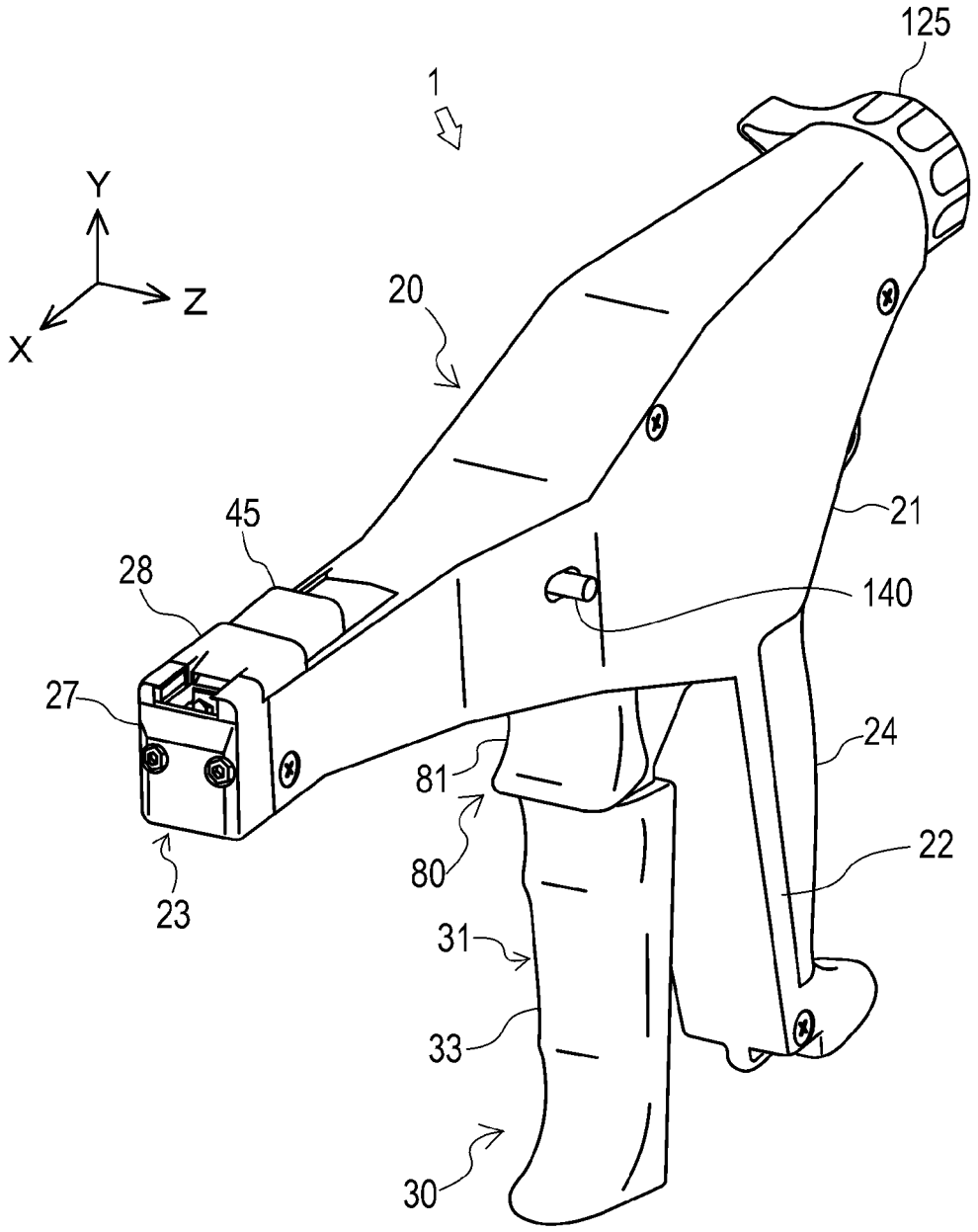
FIG. 1 is a perspective view of a manual binding tool according to one embodiment of the present invention.
Figure 2:
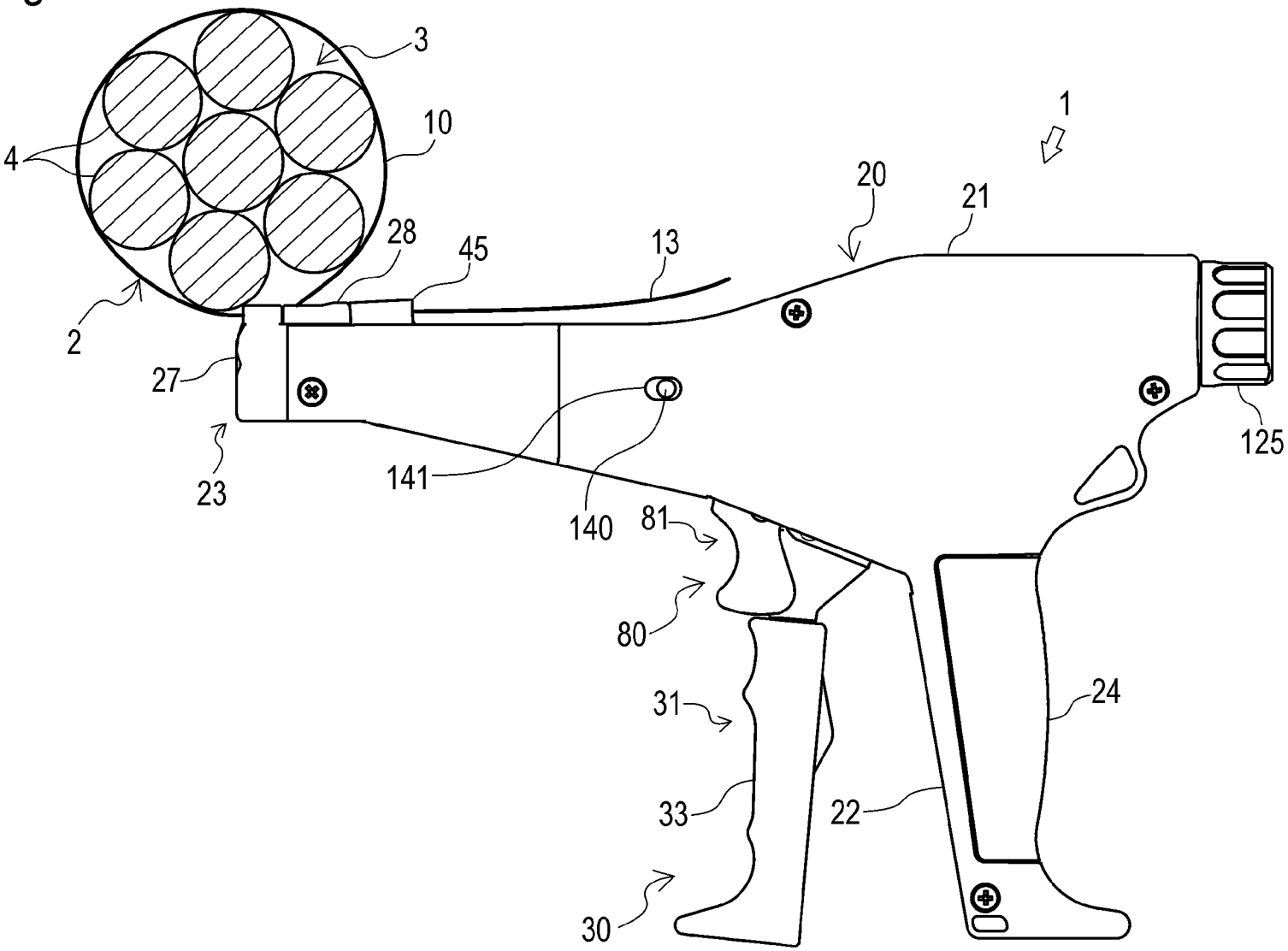
FIG. 2 is a side view of the manual binding tool shown in FIG. 1.
Figure 3A:
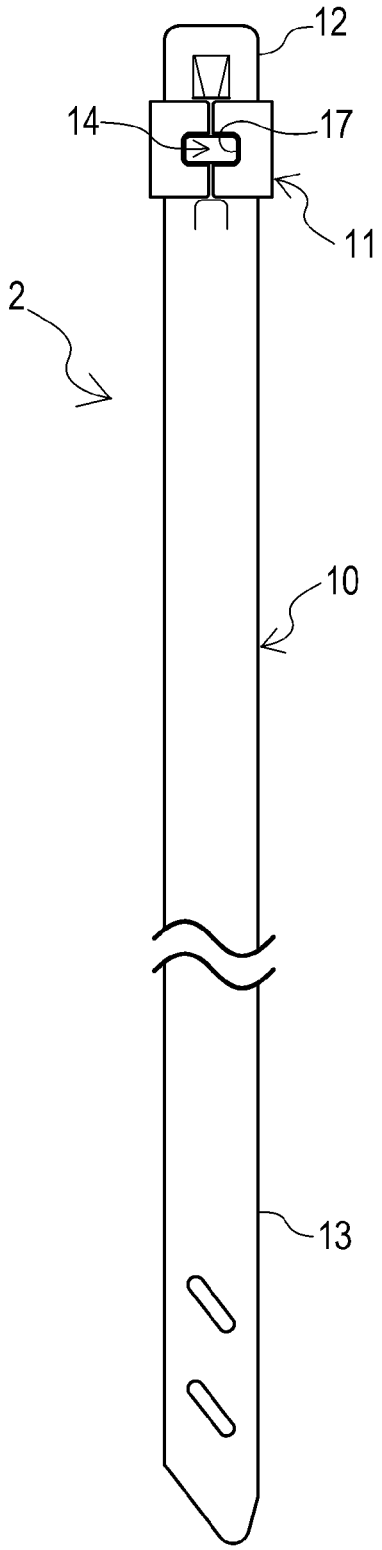
Figure 3B:
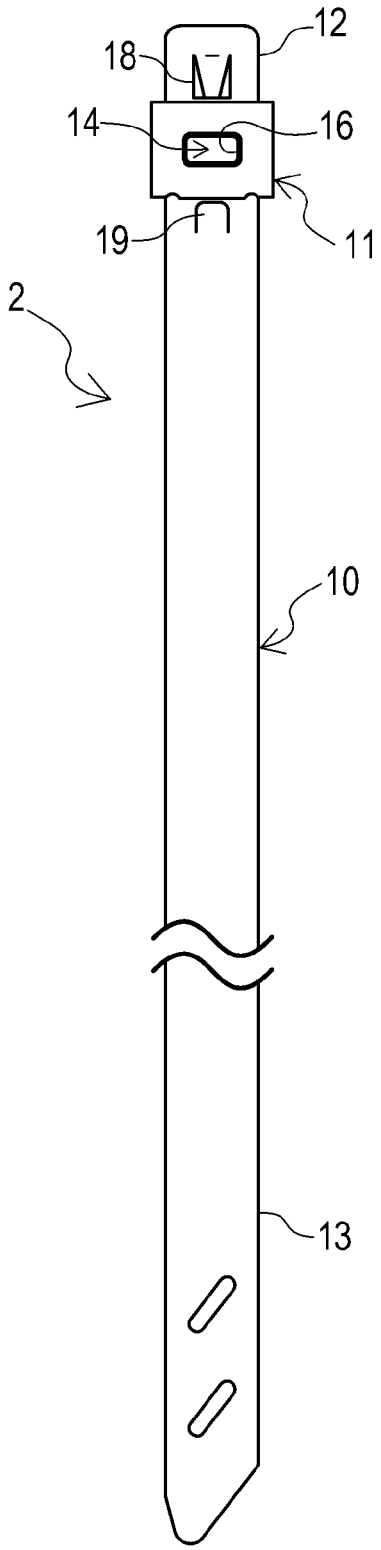
FIG. 3B is a back view of the binding band.
Figure 4A:
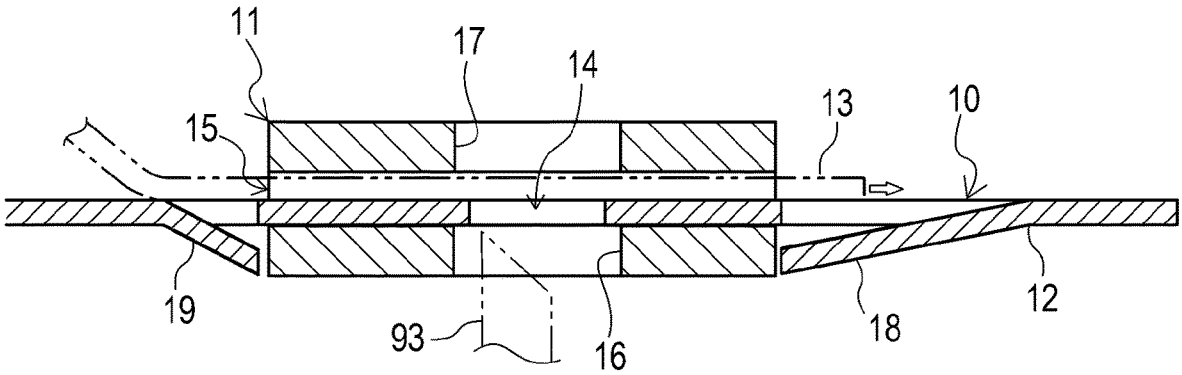
FIG. 4A is a vertical section of a base end side of the binding band shown in FIG. 3.
Figure 4B:
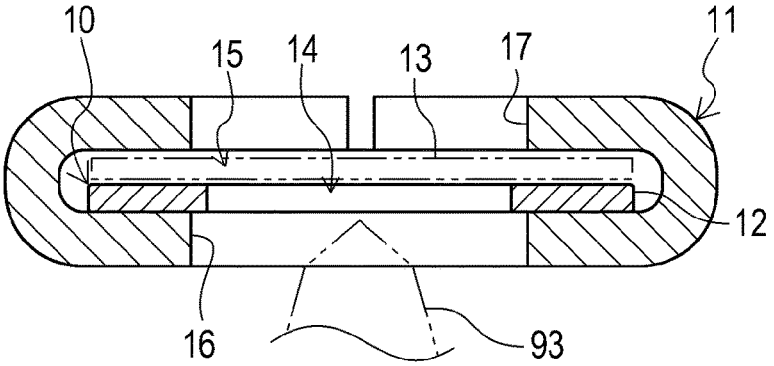
FIG. 4B is a horizontal section of the base end side thereof.

As shown in FIGS. 1, and 2, the manual binding tool 1 is used for the binding band 2 to bind the target for binding 3 using a metal binding band 2 (for example, a bundle of wire-shaped members 4, such as wire or pipe or the like). As shown in FIG. 3, the binding band 2 includes a band-shaped band unit 10, and a head unit 11 disposed at an end (base end) 12 in the length direction of the band unit 10.

Also, the manual binding tool 1 is constituted to pull to the head unit 11 the other end portion (leading end) 13 side in the length direction of the band unit 10 after being wrapped around the target for binding 3 and passing through the head unit 11 so that the binding band 2 can tighten the target to be bound 3, and to fasten the leading end portion 13 side to the base end 12 using the head unit 11 so that the tightened state of the band unit 10 is held.

In this embodiment, as can be seen in FIGS. 3A, 3B, 4A, and 4B, the band unit 10 of the binding band 2 is structured using a metal member such as a stainless steel plate or the like. It is formed to an elongated shape having a predetermined width. The base end 12 of the band unit 10 is equipped with a penetration hole 14. The leading end portion 13 of the band unit 10 has a tapered shape.

The head unit 11 is structured using a metal member such as a stainless steel plate or the like. It is formed to a C shape that can fit onto the band unit 10. The head unit 11 is equipped with a penetration hole 15 that passes through the band unit 10, a penetration hole 14, and a first opening 16 and a second opening 17 positioned coaxially to each of those, and is held at the base end 12 of the band unit 10 by projections 18, and 19.

Figure 5:
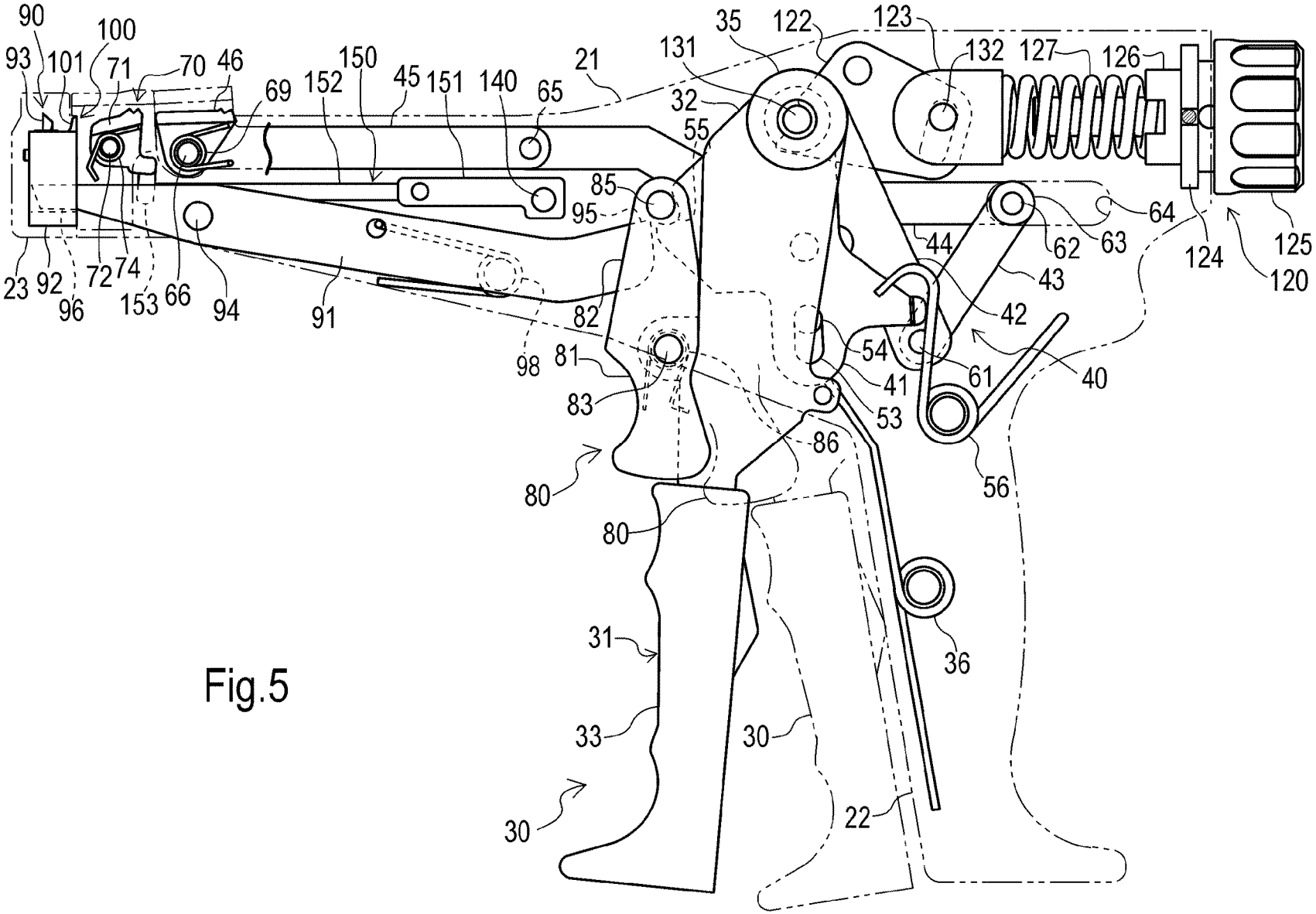
FIG. 5 is a side view of a schematic constitution of the manual binding tool shown in FIG. 1.
Figure 6:
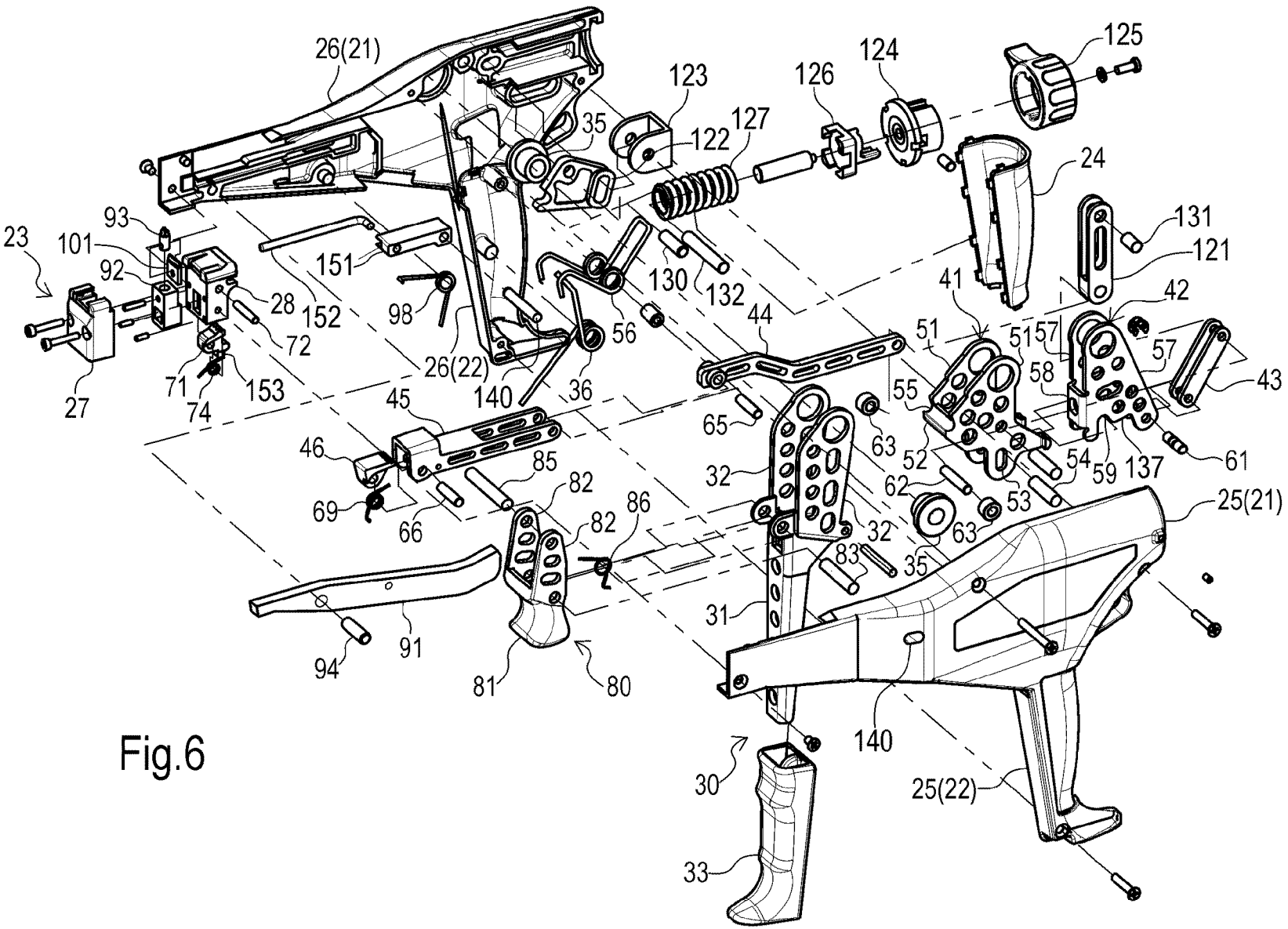
FIG. 6 is an exploded view of the manual binding tool shown in FIG. 1.

As shown in FIGS. 1, and 2, the manual binding tool 1 is equipped with a tool body 20. As shown in FIGS. 5, and 6, the tool body 20 includes a frame 21 a handle unit 22 that projects from the frame 21, and a set unit 23 coupled to the frame 21, and formed to be able to set the head unit 11 of the binding band 2.

The frame 21 and the handle unit 22 are constituted using mutually detachable left unit 25 and right unit 26. The frame 21 has a hollow shape, and extends in front and back directions so that an end portion (leading end) side becomes narrower compared to part way front and back. The handle unit 22 extends downward from part way front and back of the frame 21. A grip 24 is disposed on the handle unit 22.

In this embodiment, the tool body 20 has a pistol shape; the set unit 23 is arranged in a region (front end portion) that corresponds to a muzzle portion in the tool body 20. The set unit 23 is constituted to be able to set the head unit 11 so that the leading end portion 13 side of the band unit 10 passes through the head unit 11 (the penetration hole 15) and project toward a rear there.

Figure 7:
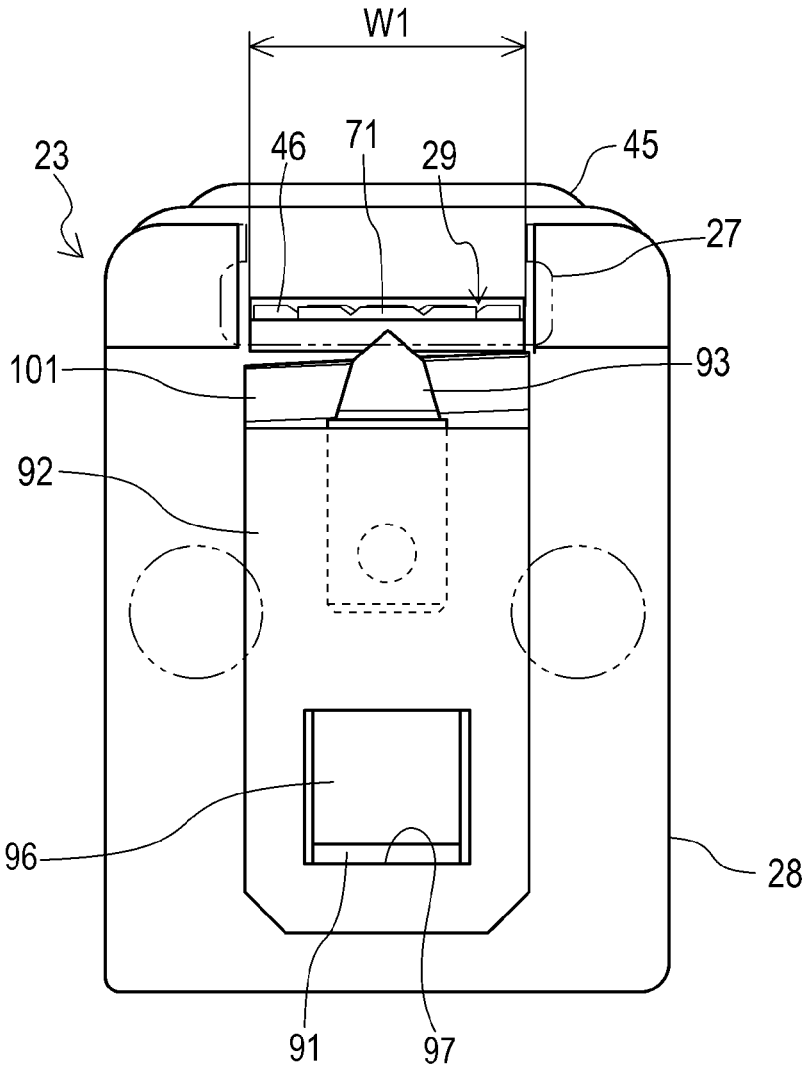
FIG. 7 is a front view of the manual binding tool shown in FIG. 1.
Figure 8:
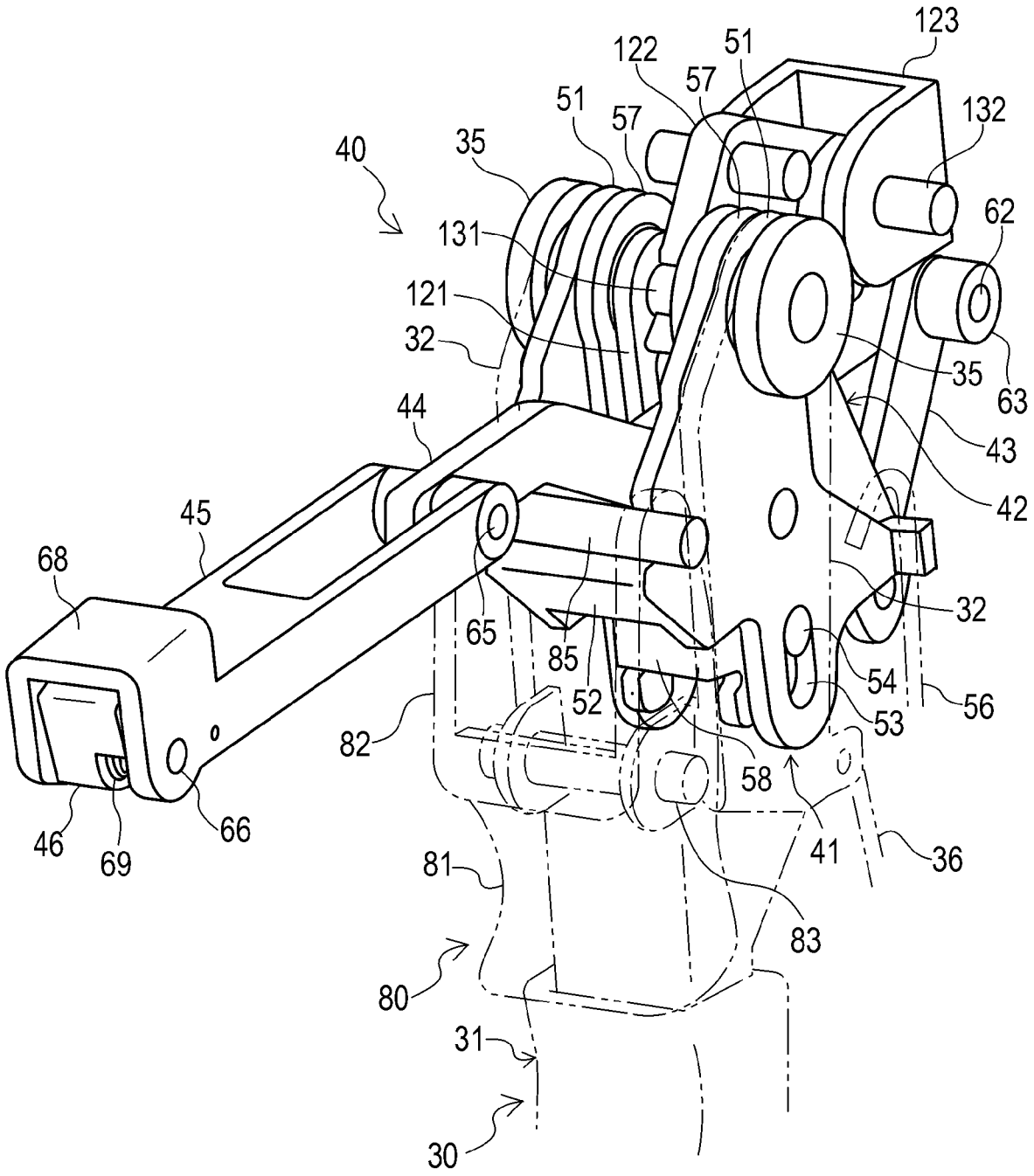
FIG. 8 is a perspective view showing a tightening mechanism in the manual binding tool shown in FIG. 1 in a first state.

As shown in FIG. 7, the set unit 23 includes a locking unit 27 that fits the head unit 11 from the front, and a guide unit 28 that guides the leading end portion 13 side of the band unit 10 that projects from the head unit 11 fitted by the locking unit 27 to the rear. The guide unit 28 includes a front path 29 that has a width W1 to pass therethrough the leading end portion 13 of the band unit 10, and is positioned at a rear of the locking unit 27.

Also, the manual binding tool 1 is equipped with a first operating tool. The first operating tool is disposed to be displaced to the tool body 20 so that it opposes the handle unit 22 of the tool body 20. In this embodiment, the first operating tool is a trigger 30 that can be artificially operated to be displaced (rotating operation), and includes a first operating unit 31, and left and right extensions 32 that extend from the first operating unit 31.

The trigger 30 extends in up and down directions. The first operating unit 31 is arranged below the frame 21, and at a front side of the handle unit 22. A grip 33 is disposed on the first operating unit 31. The left and right extensions 32 are roughly arranged in the frame 21. The left and right extensions 32 are rotatably supported by bushings 35 held by the frame 21 at the top ends of each.

Also, the trigger 30 is constituted for the first operating unit 31 to take a non-operable position (a position indicated by the solid line in FIG. 5) separated a predetermined distance from the handle unit 22, or the first operating unit 31 to take an operable position (a position indicated by the dashed-two dotted line in FIG. 5) nearer to the handle unit 22 than the non-operable position. The trigger 30 is held at the non-operable position by a force from a kick spring 36 when not in operation.

Conversely, the trigger 30 is rotated in a counterclockwise direction in FIG. 5 using the bushing 35 as a pivot point to be at the operable position when operated in resistance to the force of the kick spring 36. In this way, when operation of the trigger 30 ends, the trigger 30 is rotated in a clockwise direction in FIG. 5 by the force of the kick spring 36 to recover to the operating position.

As shown in FIGS. 8, 9, 10, 11, and 12, the manual binding tool 1 is equipped with a tightening mechanism 40. The tightening mechanism 40 is constituted to be able to pull in a direction (rear) separating from the head unit 11 the leading end portion 13 side of the band unit 10 after the head unit 11 passes through, set in the set unit 23 in response to the displacement operation of the trigger 30.

In this embodiment, the tightening mechanism 40 is roughly disposed in the frame 21 of the tool body 20, and is disposed across between the trigger 30 and leading end of the frame 21. The tightening mechanism 40 includes a tightening lever 41, a trigger link 42, a link bar 43, a rear chuck bar 44, a front chuck bar 45, and a chuck 46.

The tightening lever 41 includes left and right plates 51, and a linking unit 52 that links the left and right plates 51. A portion partway front and rear of the left and right plates 51 of the tightening lever 41 is positioned between the left and right extensions 32 of the trigger 30, and is arranged so that the linking unit 52 is positioned more to the front direction than the left and right extensions 32. The left and right plates 51 are rotatably supported on the bushing 35 at the top ends of each.

A slot 53 is disposed below the left and right plates 51 to extend in substantially a downward direction from each. A first pin 54 is inserted into the slot 53 to be able to move along a length direction of the slot 53. The first pin 54 is supported at a bottom end of a tension slide 121 described below, and held in the top portion of the slot 53 while tightening is implemented by the tightening mechanism 40. (See FIG. 18)

The linking unit 52 extends between the left and right plates 51. A recess 55 is disposed to be open toward substantially the front top direction on the front end portion of the tightening lever 41 (the front end portion and/or the linking unit 52 of each of the left and right plates 51). The recess 55 is formed to be able to fit with a switching pin 85. The switching pin 85 is detachable with the recess 55 in response to the operation of the trigger 30.

Also, the tightening lever 41 is held in the state shown in FIG. 5 by the force of the kick spring 56 when the trigger 30 is at the non-operable position. The tightening lever 41 receives the force to resist the force of the kick spring 56 via the switching pin 85 when the trigger 30 is moved from the non-operable position to the operable position, and is moved in the counterclockwise in FIG. 5, using the bushing 35 as a pivot point.

The trigger link 42 includes left and right plates 57, and the linking unit 58 that links the left and right plates 57. The trigger link 42 is arranged so that the front of the left and right plates 57 and linking unit 58 each are positioned between the left and right plates 51 of the tightening lever 41. The left and right plates 57 are rotatably supported on the bushing 35 at the top ends of each.

A recess 59 is disposed below the left and right plates 57 to open in the downward direction from each. The first pin 54 that projects from the slot 53 in the tightening lever 41 can fit in the recess 59. Also, the trigger link 42 is constituted to be able integrally to rotate with the tightening lever 41 by fitting with the pin 54 using the bushing 35 as a pivot point.

The link bar 43 has an elongated shape and is disposed at a rear side of the trigger link 42. The link bar 43 is rotatably linked via a second pin 61 to a rear lower end of the left and right plates 57 of the trigger link 42 at one end (front bottom end) in the length direction. The link bar 43 is arranged to extend from the linking portion with the trigger link 42 to the rear upper direction.

The rear chuck bar 44 extends in the rear direction, and is rotatably linked via the other end portion (rear top end portion) in the length direction of the link bar 43, and third pin 62 at one end portion (rear end portion) in the length direction. A tubular body 63 is fitted onto each of the end portions in the length direction of the third pin 62. The tubular body 63 is supported to be able reciprocally to move in a guide groove 64 disposed at an inner face side of the frame 21.

The front chuck bar 45 is linked via the length-direction other end portion (front end portion) of the rear chuck bar 44, and fourth pin 65 at one end portion (rear end portion) extending in the length direction. The front chuck bar 45 is arranged to extend from the linking portion with the rear chuck bar 44 to the front direction so that the length-direction other end portion (front end portion) is positioned at a rear of the set unit 23.

Also, the front chuck bar 45 is constituted to be able reciprocally to move in front to rear directions integrally with the rear chuck bar 44. In other words, the front chuck bar 45 is constituted integrally to be move in the rear direction along with movement by the rear chuck bar 44 to the rear direction along the guide groove 64, and to move in the front direction along with movement by the rear chuck bar 44 to the front direction along the guide groove 64.

Figure 9:
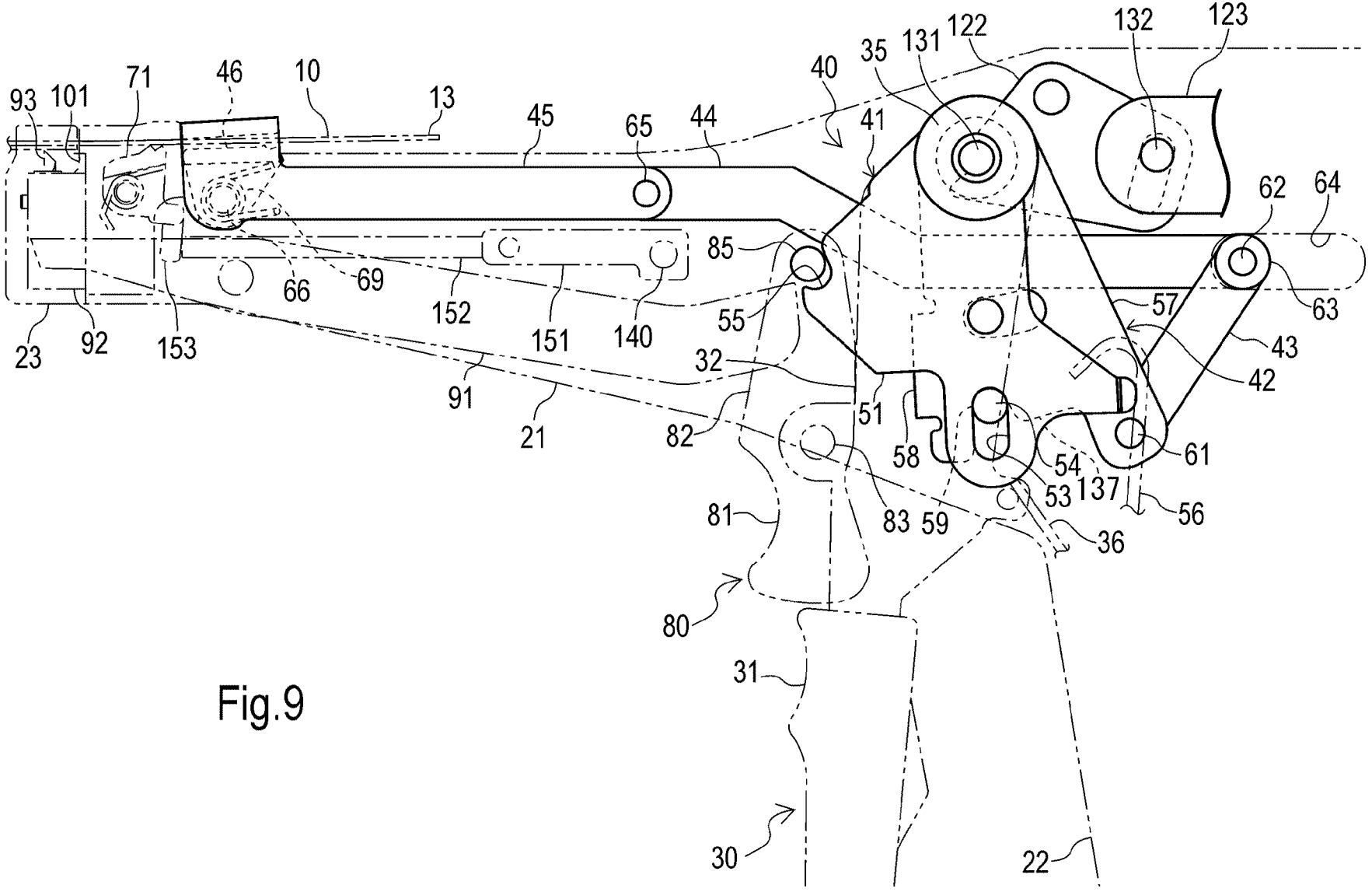
FIG. 9 is a side view showing the tightening mechanism shown in FIG. 8 in the first state.
Figure 11:
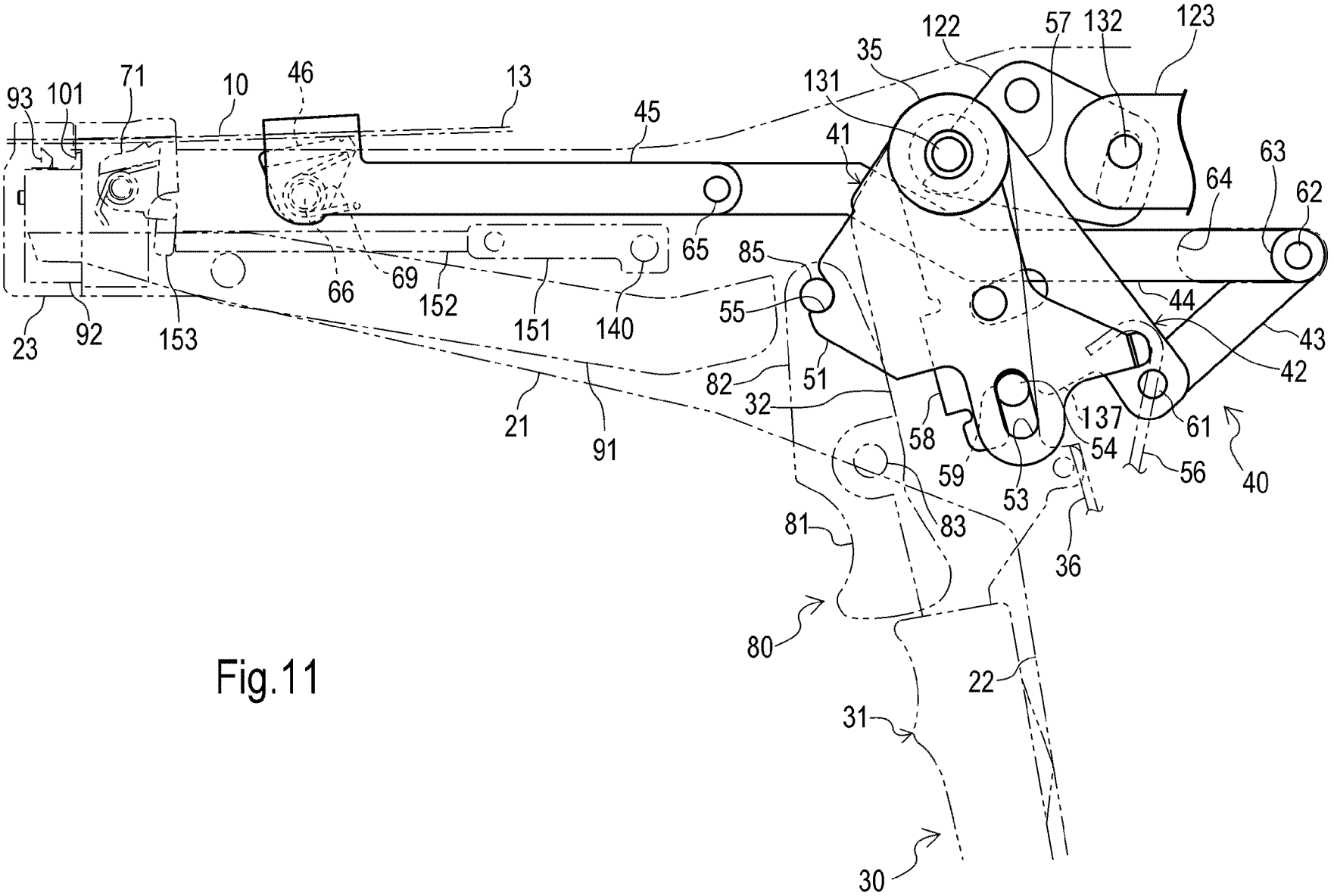
FIG. 11 is a side view showing the tightening mechanism shown in FIG. 8 in a second state.
Figure 12:
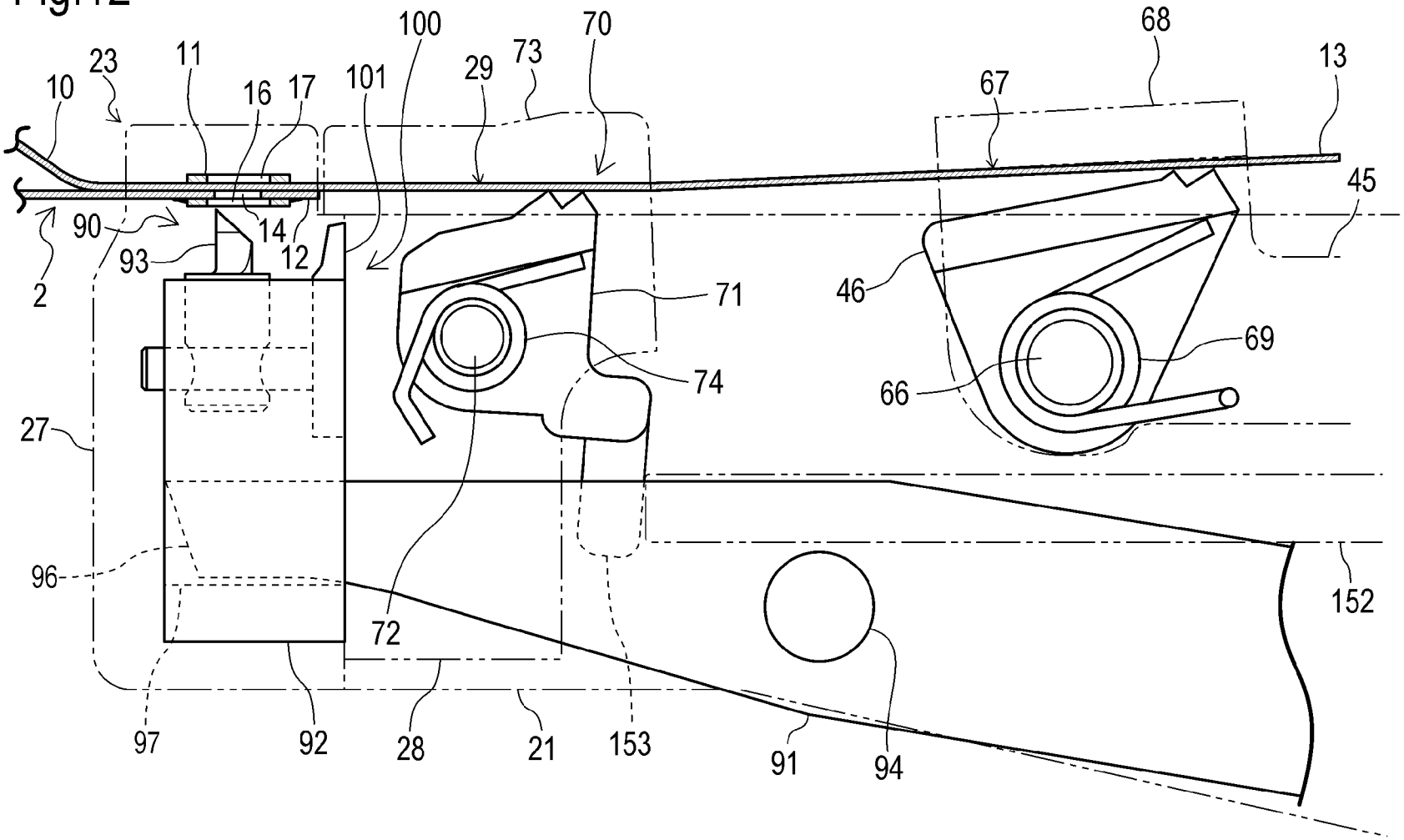
FIG. 12 is a partially enlarged view of FIG. 11.

When the front chuck bar 45 is positioned at the furthest front side, the front end portion of the front chuck bar 45 is in a state positioned just behind the set unit 23 (the guide unit 28), as shown in FIGS. 5, and 9. When the front chuck bar 45 is positioned at the furthest rear side, the front end portion of the front chuck bar 45 is in a state separated a predetermined amount to the rear from the set unit 23, as shown in FIG. 11.

Figure 10:
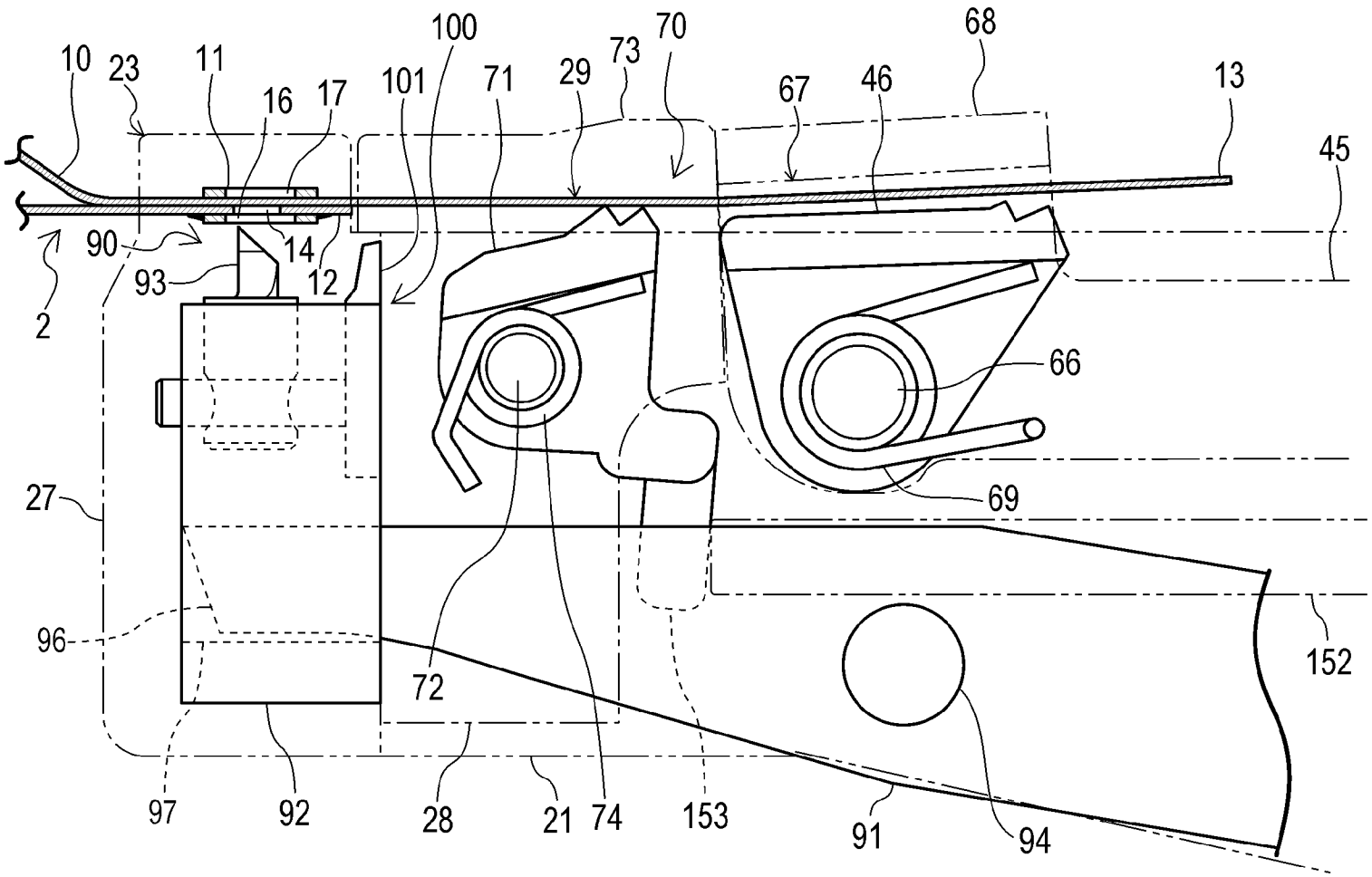
FIG. 10 is a partially enlarged view of FIG. 9.

The chuck 46 is rotatably supported on the front end portion of the front chuck bar 45 via a fifth pin 66. As shown in FIG. 10, the chuck 46 is arranged at a position that opposes the top end portion 68 of the front chuck bar 45 so that the rear path 67 that passes the leading end portion 13 side of the band unit 10 through after passing through the front path 29 is formed in the front end portion of the front chuck bar 45.

The chuck 46 is equipped with a claw that faces the rear path 67 at a rear top end portion. The chuck 46 is urged to rotate in the counterclockwise direction in FIG. 10 by the kick spring 69 to nip a portion of the leading end portion 13 side of the band unit 10 while passing through the rear path 67 using the claw of the chuck 46 by cooperating with the top end portion 68 of the front chuck bar 45.

In this way, when the chuck 46 has gripped a portion of the leading end portion 13 side of the band unit 10, it blocks return movement by the leading end portion 13 side of the band unit 10 in a direction (front direction) to come out of the rear path 67, and permits the leading end portion 13 side of the band unit 10 to advance in a direction opposite to the direction to come out of the rear path 67 (rear direction).

Also, as shown in FIG. 10, when the front end portion of the front chuck bar 45 is at the furthest front position, in other words direction behind the set unit 23, the chuck 46 touches the set unit 23 (guide unit 28) to rotate by resisting the force of the kick spring 69, and releases the rear path 67 so that the leading end portion 13 side of the band unit 10 can move.

The manual binding tool 1 is also equipped with a holding mechanism 70. The holding mechanism 70 is constituted to hold the leading end portion 13 side of the band unit 10 pulled by the tightening mechanism 40 to the tool body 20 so that it does not move to return to the head unit 11 side (front side) set in the set unit 23. In this embodiment, the holding mechanism 70 is also equipped with a return-stop chuck 71.

The return-stop chuck 71 is rotatably supported on the guide unit 28 of the set unit 23 via a sixth pin 72. As shown in FIG. 10, the return-stop chuck 71 is disposed at the front direction of the chuck 46, and continuing from the rear path 67, and arranged at a position opposing the top end portion 73 of the guide unit 28 so that the front path 29 is formed in the guide unit 28.

The return-stop chuck 71 is equipped with a claw that faces the front path 29 at a rear top end portion. The return-stop chuck 71 is urged to rotate in the counterclockwise direction in FIG. 10 by the kick spring 74 to nip a portion of the leading end portion 13 side of the band unit 10 while passing through the front path 29 using the claw of the return-stop chuck 71 by cooperating with the top end portion 73 of the guide unit 28.

In this way, when the return-stop chuck 71 has gripped a portion of the leading end portion 13 side of the band unit 10, it blocks movement by the leading end portion 13 side of the band unit 10 in a direction (front direction) to come out of the front path 29, and permits the leading end portion 13 side of the band unit 10 to move in a direction opposite to the direction to come out of the front path 29 (rear direction).

Figure 13:
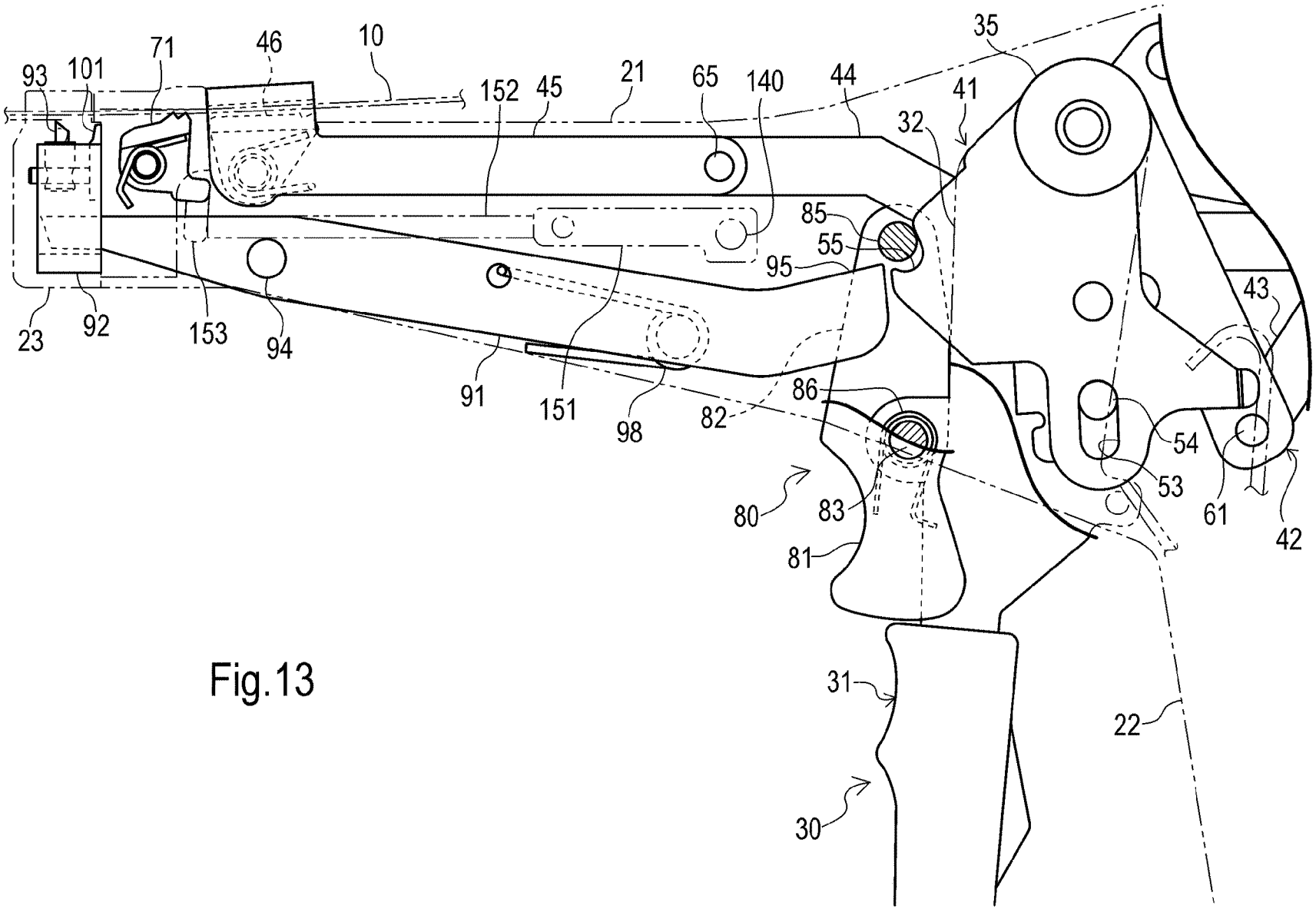
FIG. 13 is a side view showing a fastening mechanism and cutting mechanism in the manual binding tool shown in FIG. 1 in the first state.

As shown in FIG. 13, the manual binding tool 1 is equipped with a second operating tool. The second operating tool is disposed to be displaced to the tool body 20. In this embodiment, the second operating tool is constituted using a trigger 30, and a switching lever 80 as a switching tool that can artificially be operated to be displaced (rotating operation). The switching lever 80 is supported by the trigger 30.

The switching lever 80 switches a mechanism that is operated in response to displacement of the trigger 30, between the tightening mechanism 40, and the fastening mechanism 90 (in this embodiment, the fastening mechanism 90 and the cutting mechanism 100) described below. The switching lever 80 is mounted to the trigger 30 to be able to be displaced integrally with the trigger 30, and to be displaced relative to the trigger 30, when displaced.

To describe this in more detail, the switching lever 80 includes a second operating unit 81, and right and left extensions 82 that extend from the second operating unit 81. The switching lever 80 extends in substantially up and down directions, and is disposed at a front side of the trigger 30. The second operating unit 81 is arranged below the frame 21, and the right and left extensions 82 are arranged inside the frame 21.

The switching lever 80 is rotatably linked via a seventh pin 83 partway up and down of the trigger 30 partway up and down thereof. Moreover, at the switching lever 80, the switching pin 85 is disposed to extend to able to be displaced in response to the operation of the switching lever 80 and/or the trigger 30, between the top end portion of the right and left extension 82.

Also, the switching lever 80 is constituted to attain a first switching-operating position (see FIGS. 5, and 13) to which the second operating unit 81 is not displaced to the trigger 30, and a second switching-operating position (see FIGS. 14, and 15) to which the second operating unit 81 is relatively displaced to the trigger 30. The switching lever 80 is held at the first switching-operation position by the force from a kick spring 86 when not in operation.

Conversely, the switching lever 80 is rotated in a counterclockwise direction in FIG. 13 using the seventh pin 83 as a pivot point to be at the second switching-operation position when operated in resistance to the force of the kick spring 86. In this way, when operation of the switching lever 80 ends, the switching lever 80 is rotated by the force of the kick spring 86 to recover to the first switching operation position.

When the switching lever 80 is displaced along with the trigger 30 when at the first switching-operation position, the switching pin 85 is locked in the recess 55 of the tightening mechanism 40 (see FIG. 11). When the trigger 30 is operated resisting the force of the kick spring 86 when in the non-operating position, the switching lever 80 locks the switching pin 85 to a punch lever 91, described below. (See FIG. 14)

The manual binding tool 1 is equipped with the fastening mechanism 90. The fastening mechanism 90 is constituted to be able to fasten a portion of the leading end portion 13 side of the band unit 10 while passing through the head unit set in the set unit 23 in response to each displacement of the switching lever 80 and the trigger 30 using head unit 11, and to be able to fasten the leading end portion 13 side to the base end 12 of the band unit 10 using the head unit 11.

The fastening mechanism 90 is roughly disposed in the frame 21 of the tool body 20, and is disposed across between the switching lever 80, the trigger 30, and the set unit 23. The fastening mechanism 90 alternatively acts with the tightening mechanism 40 by the switching operation of the switching lever 80, and includes the punch lever 91, the holder 92, and the punch 93.

The punch lever 91 has a curved shape to convex downward, and is disposed to extend in the front and rear directions. The punch lever 91 is arranged further downward than the front chuck bar 45, and is rotatably supported on the front end portion of the frame 21 via an eighth pin 94. The eighth pin 94 is arranged further to the front than the curved portion of the punch lever 91.

A trailing end portion 95 of the punch lever 91 is arranged near a bottom of the switching pin 85 so that it is possible to be locked from below to the switching pin 85 disposed on the switching lever 80. The front end portion 96 of the punch lever 91 is inserted into an insertion hole 97 of the holder 92 to lock with the holder 92 arranged in the locking unit 27 of the set unit 23. (See FIGS. 7, and 10).

The punch lever 91 is held not to lock with the switching pin 85 by the force of the kick spring 98 when the switching lever 80 is at the first switching operating position. (See FIG. 13.) When the punch lever 91 receives a force to resist the force of the kick spring 98 via the switching pin 85, when the switching lever 80 is at the second switching operation position, it is rotated to lock with the switching pin 85. (See FIG. 14.)

After locking with the switching pin 85, the punch lever 91 is rotated in the clockwise direction in FIG. 13 using the eighth pin 94 as a pivot point, when the switching lever 80 is operated along with the trigger 30. (See FIG. 15.) Also, if the trigger 30 is not at the non-operating position when the switching lever 80 is shifted to the second switching operation position, the punch lever 91 cannot lock with the switching pin 85.

The holder 92 is disposed on the locking unit 27. The holder 92 includes the insertion hole 97 that penetrates the front and rear directions of the holder 92 and is integrally linked to the front end portion 96 of the punch lever 91 inserted into the insertion hole 97. Also, the holder 92 can be displaced in the up and down directions in response to the rotation of the punch lever 91 when the front end portion 96 is inserted into the insertion hole 97.

The punch 93 extends from the top surface of the holder 92 to be displaced in the up and down directions along with the holder 92. The punch 93 includes a pointed end formed to become tapered toward an upward direction, and is formed to pass from this projecting end through the penetration hole 14 in the band unit 10, a first opening 16 and a second opening 17 of the head unit 11.

The punch 93 is constituted to attain the non-deforming position (see FIG. 13) that does not block setting of the head unit 11 to the set unit 23, or a deformation position (see FIGS. 15, and 16) that pass through, in order, the first opening 16, the penetration hole 14, and the second opening 17 that plastically deform the leading end portion 13 side to the convex portion 99, inside the head unit 11 that is set in the set unit 23.

Also, the convex portion 99 formed at the leading end portion 13 side of the band unit 10 locks with the inner face of the second opening 17 of the head unit 11 in the length direction (front and rear directions) of the band unit 10. With this, in a state where the binding band 2 has properly tightened the target for binding 3, the leading end portion 13 side using the head unit 11 is fastened to the base end 12 thereof using the head unit 11.

The manual binding tool 1 is equipped with a third operating tool. The third operating tool is disposed to be displaced to the tool body 20. In this embodiment, the third operating tool is the same operating tool as the second operating tool, and is composed of the trigger 30, and a switching lever 80 that can artificially be operated to be displaced (rotated). In other words, the second operating tool duals as the third operating tool.

The manual binding tool 1 is equipped with the cutting mechanism 100. The cutting mechanism 100 is constituted to be able to cut the leading end portion 13 side of the band unit 10 after passing through the head unit 11 set in the set unit 23 in response to the displacement operation of the trigger 30 and the switching lever 80, to be separated in the length direction of the band unit 10.

The cutting mechanism 100 is equipped with the punch lever 91, the holder 92, and a cutter blade 101. The cutter blade 101 extends from the top surface of the holder 92 to be displaced in the up and down directions along with the holder 92. In other words, the cutter blade 101 is displaced in synchronization with the displacement of the punch 93.

The cutter blade 101 is arranged behind the punch 93. The cutter blade 101 is formed to be able to complete the cutting of the leading end portion 13 side of the band unit 10 at a time later than the starting time of the action of the punch 93 to the leading end portion 13 side of the band unit 10, when being displaced to the upward direction along with the punch 93 by the displacement of the holder 92 to the upward direction.

Also, the cutter blade 101 is constituted to be able to take a non-cutting position (see FIG. 13) where the leading end portion 13 side of the band unit 10 that projects to the rear direction from the penetration hole 15 of the head unit 11 set in the set unit 23 toward the front path 29, or the cutting position (see FIG. 15) to cut the leading end portion 13 side of the band unit 10, between the head unit 11 and the holding mechanism 70.

Next, one example of a method for implementing binding work using the manual binding tool 1 for the binding band 2 to bind the target for binding 3 will be described.

Firstly, implement a pre-treatment process to mount the binding band 2 to the manual binding tool 1 and the target for binding 3. In other words, wrap the band unit 10 of the binding band 2 around the target for binding 3. Also, set the head unit 11 of the binding band 2 on the set unit 23 (the locking unit 27) of the manual binding tool 1 and the tool body 20.

Pass the band unit 10, in order, from the leading end portion 13 side thereof through the penetration hole 15 of the head unit 11, the front path 29 in the manual binding tool 1, and the rear path 67, and hold the leading end portion 13 side of the band unit 10 in a state held by the holding mechanism 70. Also, according to this embodiment, if the work relating to the binding band 2 must be redone, it is possible to do that using a release mechanism 150, described below.

Also, to temporarily tighten the binding band 2, pull the leading end portion 13 side of the band unit 10 after passing through the rear path 67 in a direction (rear direction) to separate from the head unit 11 with an artificial operation. At that time, movement of the leading end portion 13 side of the band unit 10 is blocked by the return-stop chuck 71 in the holding mechanism 70, and the chuck 46 in the tightening mechanism 40, as described above.

After the pre-treatment process, implement the pulling and tightening process of the band unit 10 until the binding band 2 is in a predetermined tightening state to the target for binding 3, using the tightening mechanism 40 in the manual binding tool 1. Specifically, grip the handle unit 22 and the trigger 30 in the tool body 20, and operate to displace the trigger 30 from the non-operating position shown in FIG. 9 to the operating position shown in FIG. 11.

During the operation, the switching lever 80 will be displaced along with the trigger 30 while at the first switching operation position, so the switching pin 85 is first displaced to the rear to be locked with the recess 55, and then displaced further to the rear in a state where it is locked with the recess 55. For that reason, the tightening lever 41 is pushed by the switching pin 85, and rotated in the clockwise direction in FIG. 9 using the bushing 35 as a pivot point.

The first pin 54 inserted to the slot 53 is displaced to the rear direction by the rotation of the tightening lever 41. Because the first pin 54 is locked to the recess 59, the trigger link 42 is pushed by the first pin 54 and rotates in the clockwise direction in FIG. 9 using the bushing 35 as a pivot point. For that reason, the link bar 43 is displaced to move the trailing top end portion in the rear direction along the guide groove 64.

The rear chuck bar 44 moves in the rear direction by the displacement of the link bar 43. Along with this, the front chuck bar 45 moves in the rear direction. Therefore, firstly, the chuck 46 starts to move in the rear direction to separate the set unit 23 to grip the leading end portion 13 side of the band unit 10 in the rear path 67, and next it moves further in the rear direction while gripping the leading end portion 13 side of the band unit 10.

Therefore, it is possible to pull the leading end portion 13 side of the band unit 10 in the rear direction to the head unit 11 so that the tightening mechanism 40 raises the tightening force of the binding band 2 a predetermined amount. Also, thereafter, the trigger 30 is released to return to its original state. With this, the tightening mechanism 40 returns to its original state to be able to move through re-operation of the trigger 30.

In the tightening process, implement the operation of the trigger 30 described above at least once until the tightening force of the binding band 2 reaches the predetermined tightening force. Also, it is acceptable visually to judge a state of the binding band 2, for example, when the tightening process ends (whether the tightening force of the binding band 2 has reached the predetermined tightening force), and to judge using the tightening-force adjustment mechanism 120 described below.

After the tightening process, implement the fastening process to fasten the leading end portion 13 side thereof to the base end 12 of the band unit 10, using the fastening mechanism 90. Specifically, firstly, grip the handle unit 22 and the switching lever 80 while the trigger 30 is at the non-operating position, and operate the switching lever 80 to be displaced from the first switching operation position shown in FIG. 13 to the second switching operation operating position shown in FIG. 14.

Figure 15:
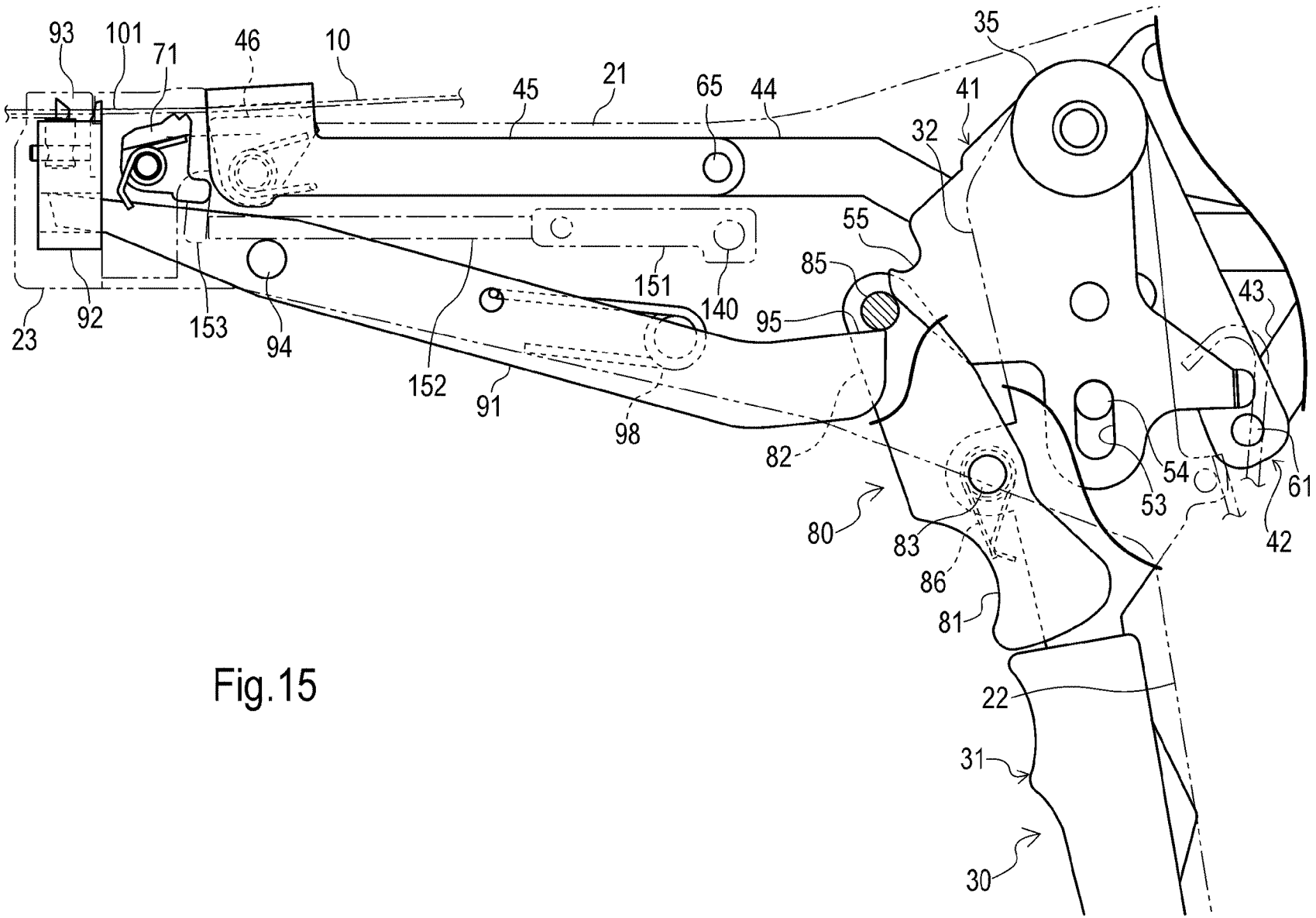
FIG. 15 is a side view showing the fastening mechanism and cutting mechanism shown in FIG. 13 in the third state.

In this way, lock the switching pin 85 from above the trailing end portion 95 of the punch lever 91 so that the mechanism to operate is switched in response to the displacement of the trigger 30. Also, while the switching lever 80 is displaced to the second switching operation position in this way, further grip the trigger 30 to operate it to be displaced to the operating position along with the switching lever 80, as shown in FIG. 15.

Figure 14:
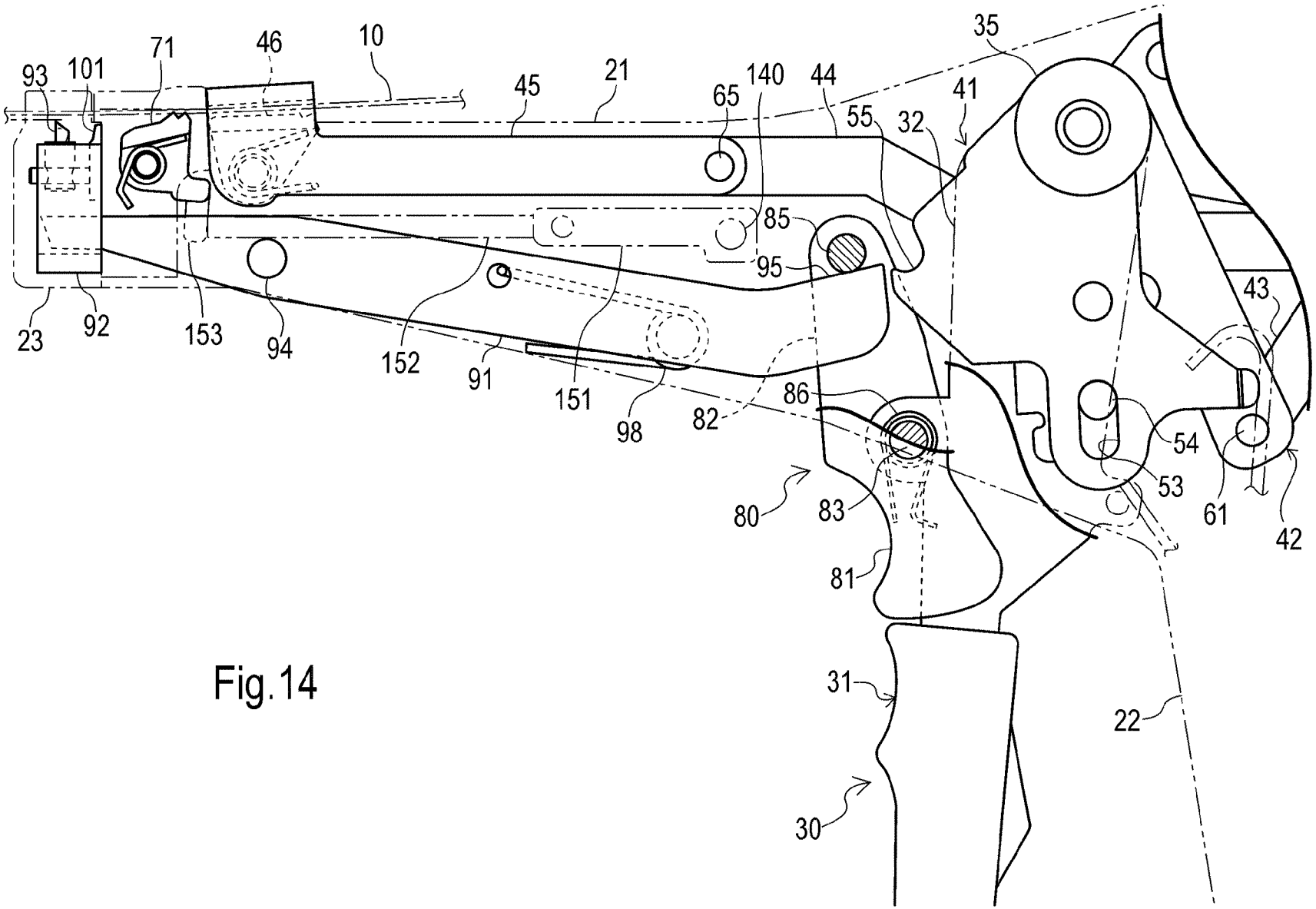
FIG. 14 is a side view showing the fastening mechanism and cutting mechanism shown in FIG. 13 in the second state.
Figure 16:
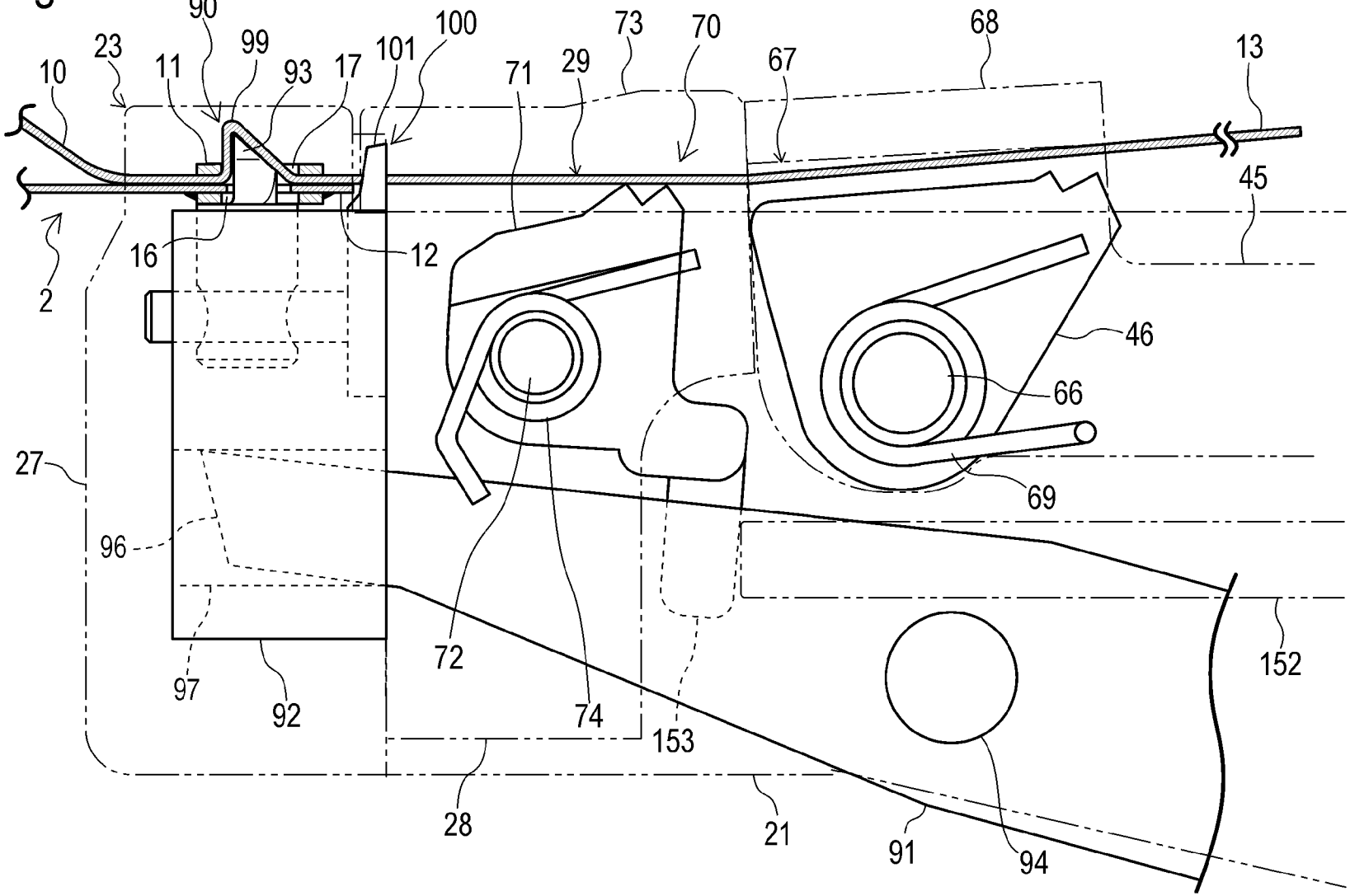
FIG. 16 is a partially enlarged view of FIG. 15.

While performing this operation, the punch lever 91 is pushed by the switching pin 85 and rotates in the clockwise direction in FIG. 14 using the eighth pin 94 as a pivot point. For that reason, the holder 92 is displaced upward. Therefore, the punch 93 is displaced upward to displace a portion of the leading end portion 13 side of the band unit 10 in the head unit 11 set in the set unit 23, to the convex portion 99, as shown in FIG. 16.

Still further, after the tightening process (the fastening process) ends, implement the cutting process using the cutting mechanism 100 to remove excess portions of the leading end portion 13 side of the band unit 10. In this embodiment, it is possible to implement the cutting process and the fastening process substantially simultaneously by operating the switching lever 80 and the trigger 30 once in the fastening process.

In other words, when the holder 92 is displaced upward by operating the switching lever 80 and the trigger 30 as described above, the cutter blade 101 starts to be displaced upward to cut the leading end portion 13 side of the band unit 10 between the return-stop chuck 71, and the head unit 11 set in the set unit 23 after fastening is started using the fastening mechanism 90.

Therefore, the fastening mechanism 90 fastens the leading end portion 13 side of the head unit 11 to the base end 12 using the head unit 11. Moreover, the cutting mechanism 100 cuts and removes the excess portion at the leading end portion 13 side of the head unit 11. Thereafter, the trigger 30 and the switching lever 80 are released to return to their original states.

For that reason, the fastening mechanism 90 and the cutting mechanism 100 are returned to their original states. Also, after the fastening process and the cutting process are ended in this way, the head unit 11 is released from the set unit 23, and the excess portion of the leading end portion 13 side of the head unit 11 is removed from the holding mechanism 70 or the like. With this, implementation of the binding operation is completed using the manual binding tool 1.

In light of the description above, according to the manual binding tool 1, it is possible to bind the target for binding 3, using the binding band 2 that includes a predetermined tightening force. When doing so, fastening of the band unit 10 by the fastening mechanism 90, and cutting of the band unit 10 by the cutting mechanism 100 are possible at any time, regardless of the operation results of the tightening mechanism 40.

Therefore, it is possible to execute the tightening of the band unit 10 while visually checking or the like, until the actual degree of tightening of the target for binding 3 is proper using the binding band 2. Therefore, it is possible to circumvent executing the fastening of the band unit 10 by the fastening mechanism 90, and the cutting of the band unit 10 by the cutting mechanism 100 when the tightening of the band unit 10 is insufficient.

In other words, it is possible to circumvent the execution of the fastening and cutting of the band unit 10 for example when the binding band 2 is tightened so tightly as to damage the target for binding 3, or when it is tightened so weakly that the bundle of a plurality of wire members that are the target for binding 3 come loose. The result is that it is possible to execute the appropriate tightening of the binding band 2.

Also, in this embodiment, the tool body 20 has a pistol shape; the set unit 23 is arranged in a region that corresponds to a muzzle portion in the tool body 20. In other words, the set unit 23 is disposed at a comparatively narrow front end portion (leading end portion) in the tool body 20; it is possible to extend the band unit 10 from the head unit 11 set in the set unit 23 when implementing the binding work.

With this kind of constitution, even if the target for binding 3 is arranged where the working space of the location where the setup item is located in an area around it is a comparatively narrow area, it is easier for the set unit 23 (head unit 11) near the target for binding 3, when using the manual binding tool 1. Therefore, it is possible to improve the operability of the manual binding tool 1 and the binding band 2.

Also, in this embodiment, the set unit 23 is arranged at the leading end portion of the frame 21 so that it is positioned at an opposite side (upper side) to the projecting direction of the handle unit 22, so when the binding band 2 is mounted to the manual binding tool 1, it is possible to prevent the problem of the leading end portion 13 side of the band unit 10 hitting the hand gripping the trigger 30 or the like when the band unit 10 is pulled.

Figure 17A:
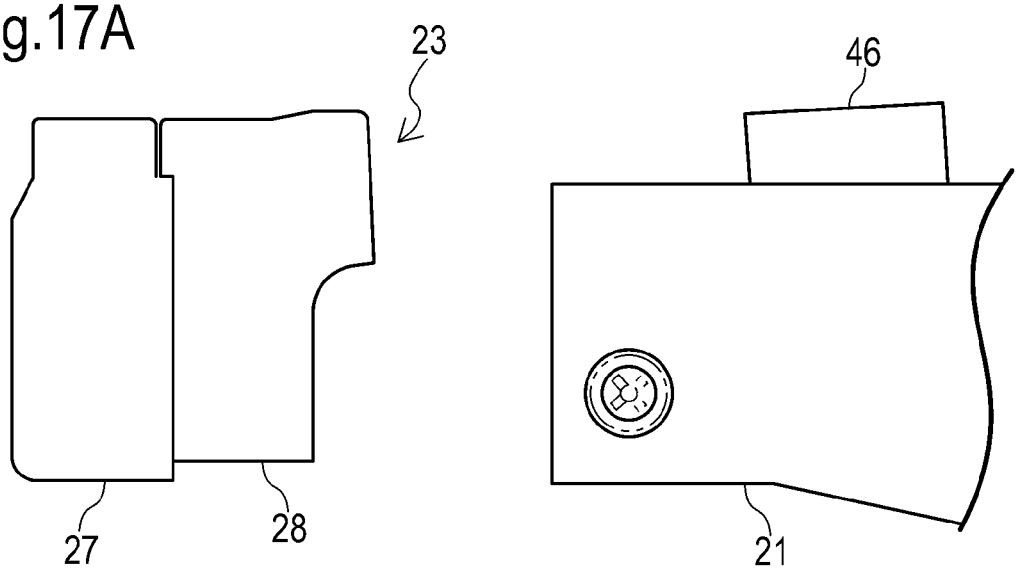
FIG. 17A is a side view of the set unit in the manual binding tool shown in FIG. 1 removed from the frame.
Figure 17B:
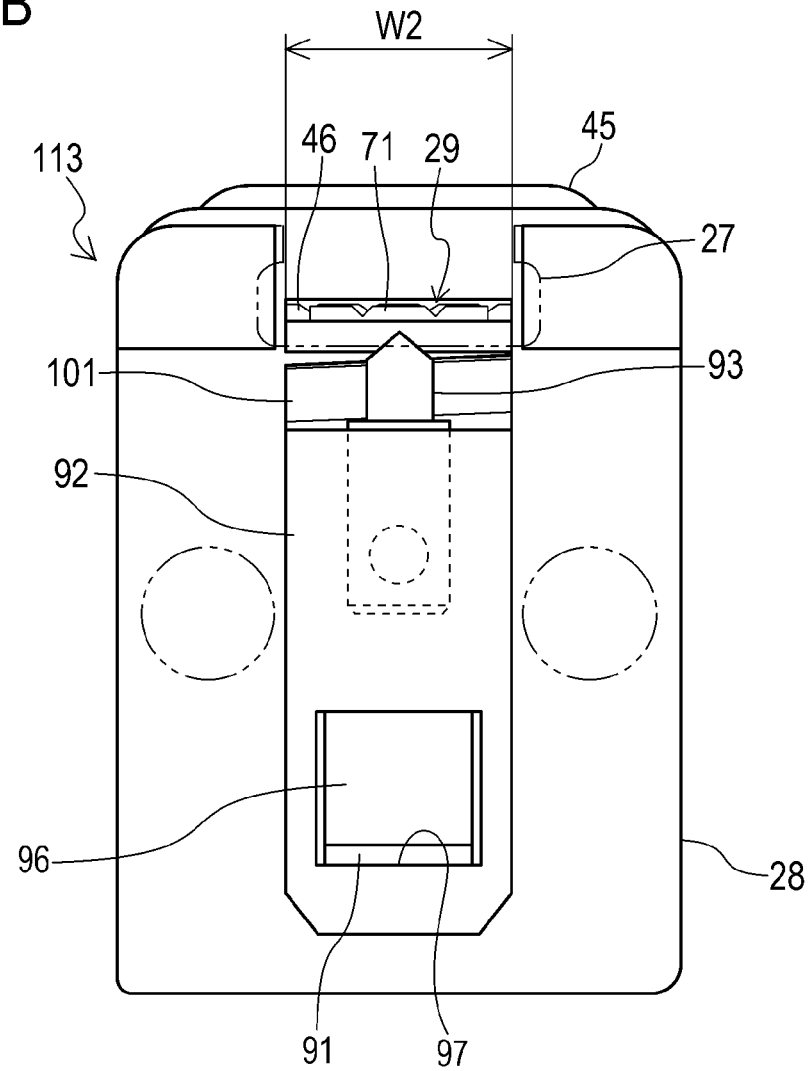
FIG. 17B is a front view of the set unit that is different from that set unit.

Also, in this embodiment, the set unit 23 of the tool body 20 is detachably mounted to the frame 21, as shown in FIGS. 2 and 17A. Therefore, it is possible to use a majority of the manual binding tool 1 on another binding band that has a band width that is different from the binding band 2 simply by changing the set unit 23 to another set unit 113 (see FIG. 17B) that includes the front path 29 having a width W2.

Specifically, when implementing binding work using another binding band, it is possible to use the manual binding tool 1 (excluding the set unit 23) simply by changing the other set unit 113 that was prepared separately to the set unit 23. Therefore, it is possible to handle the manual binding tool 1 with a variety of binding bands at low cost without having to prepare a manual binding tool (the entire tool) that is different from the manual binding tool 1.

Also, in this embodiment, the switching lever 80 is mounted to the trigger 30 to be able integrally to be displaced with the tool body 20 and the trigger 30 and relatively to be displaced to the trigger 30, to be able to be gripped together with the handle unit 22 and the trigger 30.

With this kind of constitution, when operating to switch the mechanism that is operated in response to displacement of the trigger 30 from the tightening mechanism 40 to the fastening mechanism 90 and the cutting mechanism 100 after the handle unit 22 and the trigger 30 have been operated to operate the tightening mechanism 40, it is possible further to grip the switching lever 80 while the trigger 30 is gripped, and to operate the switching lever 80, and additionally the trigger 30, without switching the trigger 30 from one hand to the other. Therefore, it is possible simply and quickly to execute operations using the manual binding tool 1.

Also, in this embodiment, the manual binding tool 1 includes a mechanism that disables switching by the switching lever 80 while the trigger 30 is displaced. In other words, when the trigger 30 is positioned displaced from the non-operating position to operate the tightening mechanism 40, the switching pin 85 will become unable to lock with the punch lever 91 even if the switching lever 80 is operated.

With this kind of constitution, it is possible to prevent mistakenly operating the fastening mechanism 90 and the cutting mechanism 100 so that the fastening and cutting relating to the band unit 10 are executed, when switching lever 80 is unintentionally displaced (for example, a finger not gripping the trigger 30 and the handle unit 22 in the tightening process touches the switching lever 80).

Also, in this embodiment, the manual binding tool 1 is equipped with the tightening-force adjustment mechanism 120. The tightening-force adjustment mechanism 120 is for adjusting to raise and lower the maximum value of the tightening force of the binding band 2 by the tightening mechanism 40. As described above, it is possible to judge when the tightening process ends based on the maximum value (setting value) set by the tightening-force adjustment mechanism 120.

Figure 18:
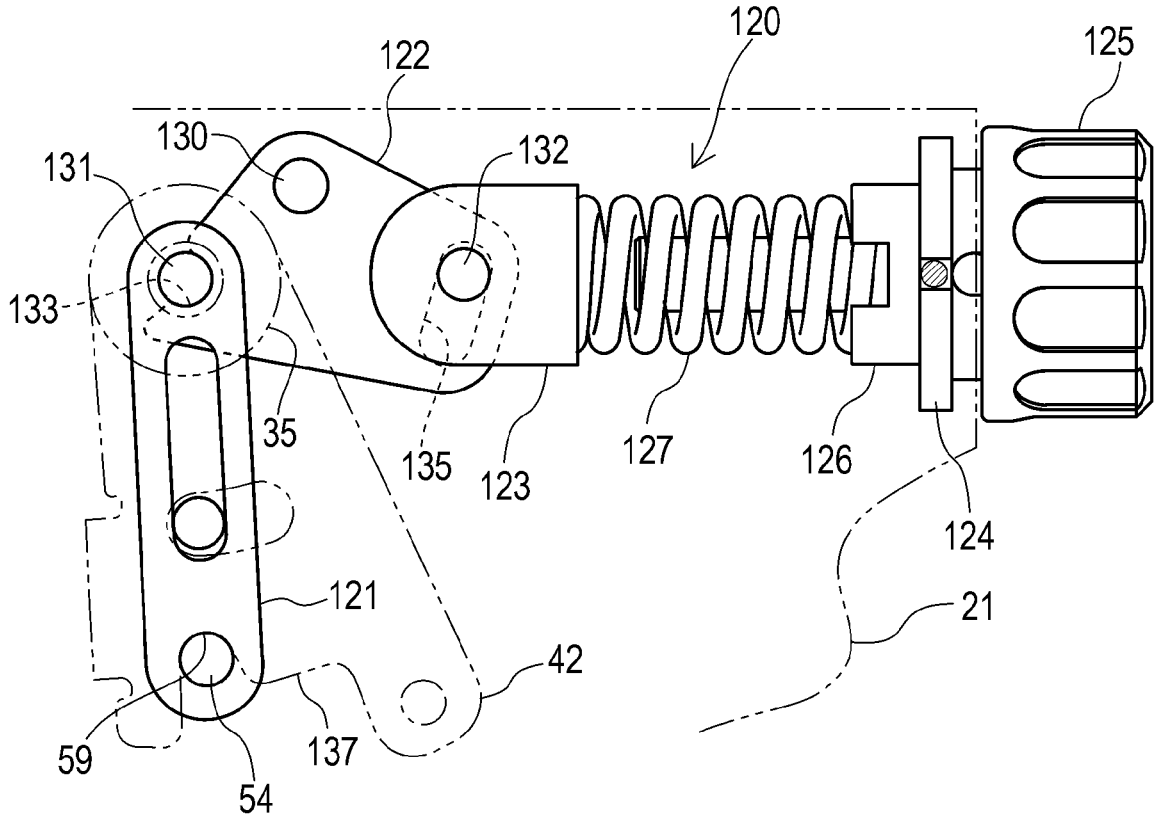
FIG. 18 is a side view of a tightening-force adjustment mechanism in the manual binding tool shown in FIG. 1 in the first state.

As shown in FIGS. 5, 6, and 18, the tightening-force adjustment mechanism 120 includes the tension slide 121, the tension through 122, the tension plate 123, the tension base 124, the tension dial 125, the rolling cam 126, and the compressed coil spring 127. The tightening-force adjustment mechanism 120 is disposed behind the frame 21.

The tension slide 121 extends in up and down directions, and is arranged between the left and right plates 57 in the trigger link 42. A bottom end of the tension slide 121 is linked to the tightening lever 41 and the trigger link 42 via the first pin 54, a top end of the tension slide 121 is linked to the tension through 122 via a roller pin 131.

The tension through 122 is arranged at a rear side of the bushing 35, and is rotatably supported on the frame 21 via a ninth pin 130. A recess 133 that rotatably fits the roller pin 131 is disposed in front of the tension through 122. A slot 135 that penetrates allowing the tenth pin 132 reciprocally to move generally in front and rear directions is disposed behind the tension through 122.

The tension plate 123 is U-shaped. The tension plate 123 is arranged sandwiching the tension through 122 from the left and right so that its blocked portion is positioned at a rear of the tension through 122. The tension plate 123 is linked to the tension through 122 via the ninth pin 130.

The tension base 124 is arranged at a predetermined space in a rear direction of the blocked portion of the tension plate 123. The tension dial 125 is disposed at a rear of the tension base 124 to be exposed to the outside of the frame 21. The rolling cam 126 is disposed at a front side of the tension base 124 to be able reciprocally to move in the front and rear directions to the frame 21.

The tension dial 125 is held at any of a plurality of rotating states. The rolling cam 126 is held at a position moved a predetermined amount in the front and rear directions in response to the rotated state of the tension dial 125. Also, the compressed coil spring 127 is disposed between the tension plate 123 and the rolling cam 126 so that the expansion and contraction direction is in the front and rear directions.

If the tightening force of the binding band 2 is between up to reaching the maximum value when the tightening mechanism 40 is operated, the roller pin 131 is pushed with a predetermined force to the front side by the tension through 122 so that its position is held, and the tension slide 121 rotates interlocked to the tightening lever 41 and the trigger link 42 using the roller pin 131 as a pivot point.

Figure 19:
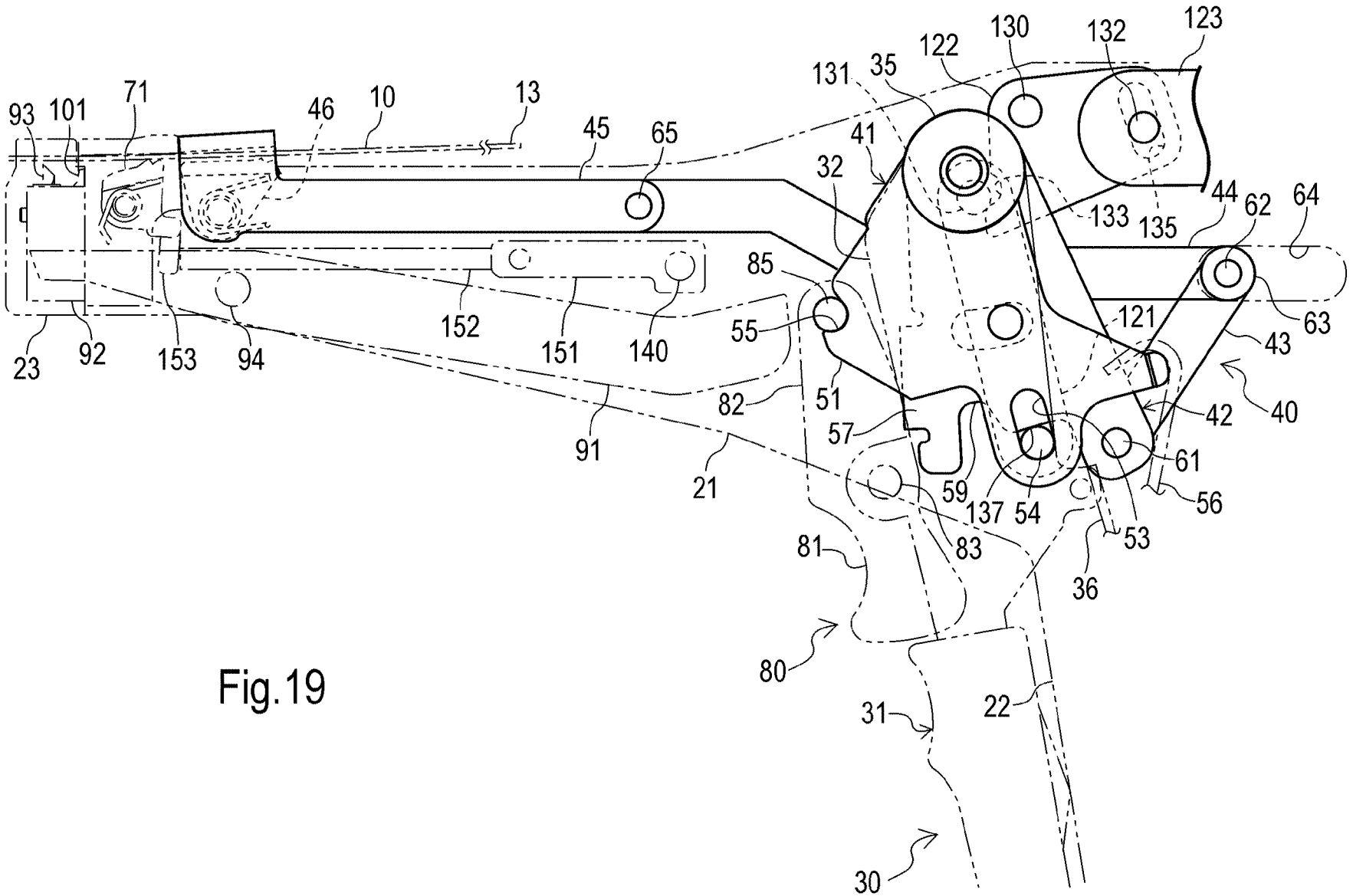
FIG. 19 is a side view showing the tightening-force adjustment mechanism in shown in FIG. 18 in the second state.

Also, if the tightening force of the binding band 2 reaches the maximum value, the tension through 122 rotates so that the tension slide 121 is displaced as shown in FIG. 19 when the trigger 30 is operated. At that time, the first pin 54 moves below the slot 53 to release the lock with the recess 59 of the trigger link 42, and moves to a level 137 installed consecutively to the recess 59.

With this, the trigger link 42 is interlocked to the tightening lever 41. For that reason, the rear chuck bar 44 and the front chuck bar 45 do not reciprocally move even if the tightening lever 41 is rotated. Therefore, in this case, although the trigger 30 is displaced, the tightening force of the binding band 2 by the tightening mechanism 40 will not rise any further.

With this kind of constitution, when the tension dial 125 is rotated in one direction left and right, the movement of the rolling cam 126 holds the compressed coil spring 127 in the compressed state, and it is possible to push the tension through 122 (roller pin 131) with a stronger force. For that reason, it is possible to adjust the maximum value of the tightening force of the binding band 2 by the tightening mechanism 40 in a rising direction.

Conversely, when the tension dial 125 is rotated in the other direction left and right, the movement of the rolling cam 126 holds the compressed coil spring 127 in the extended state, and it is possible to push the tension through 122 (roller pin 131) with a weaker force. For that reason, it is possible to adjust the maximum value of the tightening force of the binding band 2 by the tightening mechanism 40 in a lowering direction.

Also, in this embodiment, the plurality of rotating states for the tension dial 125 includes a predetermined rotating state that disables the action of the tightening-force adjustment mechanism 120. The description of the tightening-force adjustment mechanism 120 relates to when the tension dial 125 was rotated in any rotating state excluding the predetermined rotating state.

Also, as shown in FIG. 5, the manual binding tool 1 is equipped with a release operating tool. The release operating tool is disposed to be able to displace to the tool body 20. The release operation tool is a release pin 140 that can artificially be operated. The release pin 140 is disposed to extend in left and right directions, the end portion side in the length direction (left end side) is arranged to penetrate a slot 141 in the frame 21.

The release pin 140 is disposed to be able to be displaced in the front and rear directions along the slot 141 to the frame 21. It takes the non-released operating position that is positioned at a rear side of the slot 141, and the release operating position that is positioned further at a front side of the slot 141 than the non-release operating position. The release pin 140 is held in a state that is exposed outside the frame 21.

Figure 20:
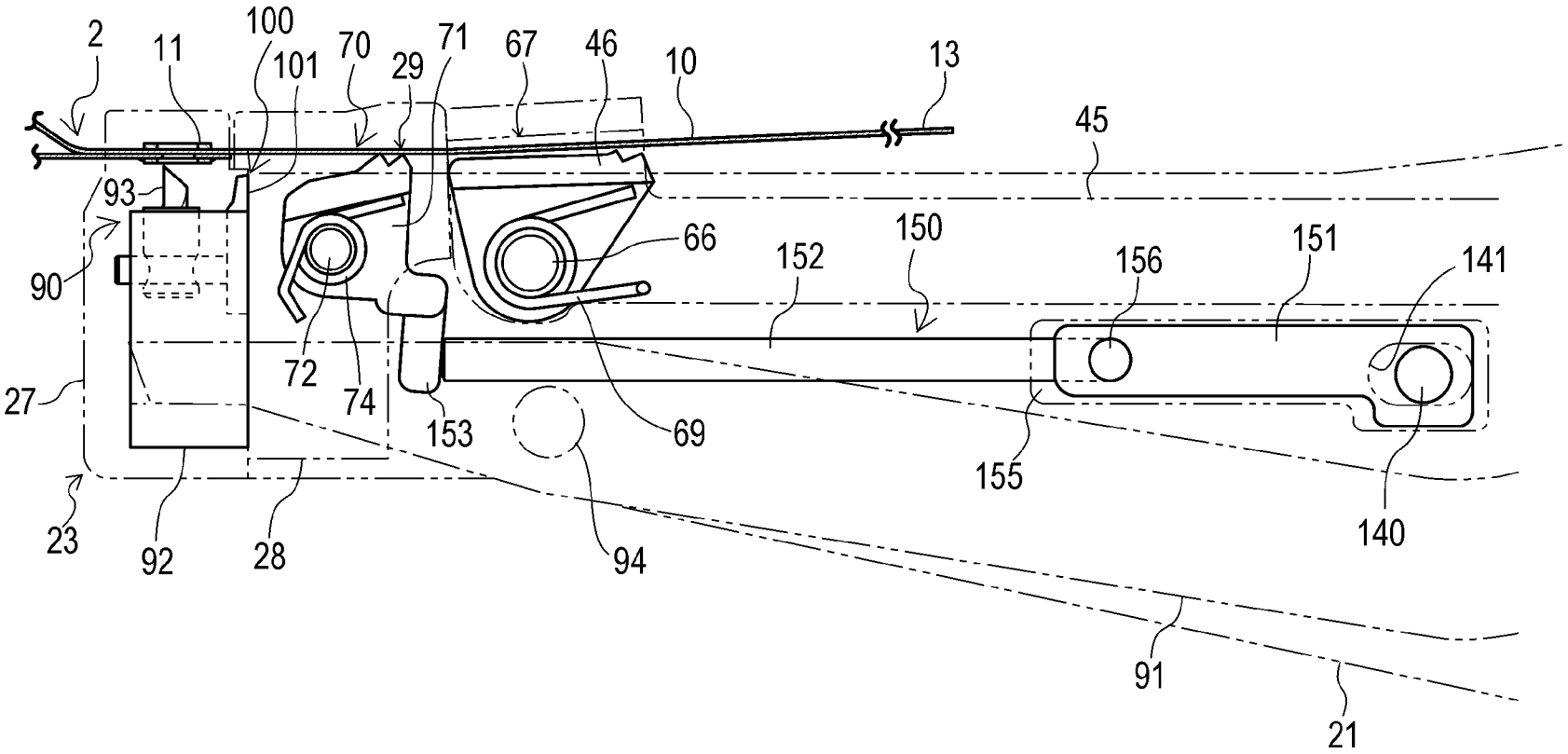
FIG. 20 is a side view of a release mechanism in the manual binding tool shown in FIG. 1 in the first state.
Figure 21:
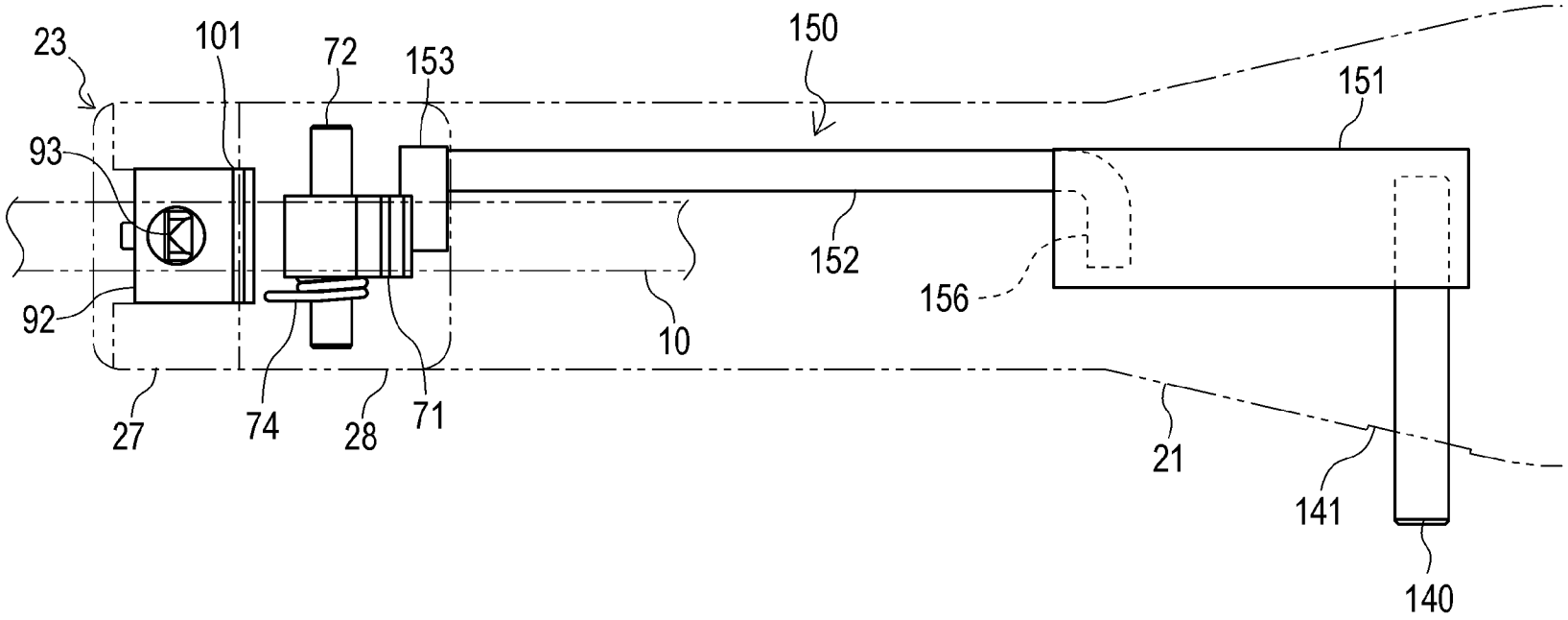
FIG. 21 is a plan view of the release mechanism shown in FIG. 20.

Also, in this embodiment, the manual binding tool 1 is equipped with a release mechanism 150. The release mechanism 150 is constituted to release the holding by the holding mechanism 70 of the band unit 10 in the binding band 2 in response to the displacement of the release pin 140. As shown in FIGS. 20, and 21, the release mechanism 150 includes a movement body 151, a pushing body 152, and a linked body 153.

The movement body 151 is disposed to extend in the front and rear directions, and is arranged behind the holding mechanism 70 (the return-stop chuck 71). The movement body 151 is supported by the frame 21 to be able reciprocally to move in the front and rear directions along the guide groove 155 disposed at an inner face side of the frame 21. Another end portion side (right end portion side) in the length direction of the release pin 140 is fastened to a rear portion of the movement body 151.

The pushing body 152 is composed of a rod-shaped member and is disposed to extend in the front and rear directions. The pushing body 152 is arranged to be able reciprocally to move in front and rear directions between the movement body 151 and the return-stop chuck 71. A curved portion 156 is disposed at a rear end portion of the pushing body 152. The pushing body 152 is integrally linked to the movement body 151 via the curved portion 156.

The linked body 153 is arranged in front of the pushing body 152. The linked body 153 is integrally disposed on the return-stop chuck 71 to move in conjunction with the return-stop chuck 71. The linked body 153 includes a contact face that opposes the front end of the pushing body 152, and is able to touch the front end of the pushing body 152 with this contact face.

As shown in FIGS. 20, and 21, the front end portion of the pushing body 152 touches (or separates from) the linked body 153 in the release mechanism 150 when the release pin 140 is at the non-release operating position. For that reason, at that time, action of the holding mechanism 70 (the action where the return-stop chuck 71 grips the leading end portion 13 side of the band unit 10) can be implemented by the release mechanism 150 without being blocked.

Figure 22:
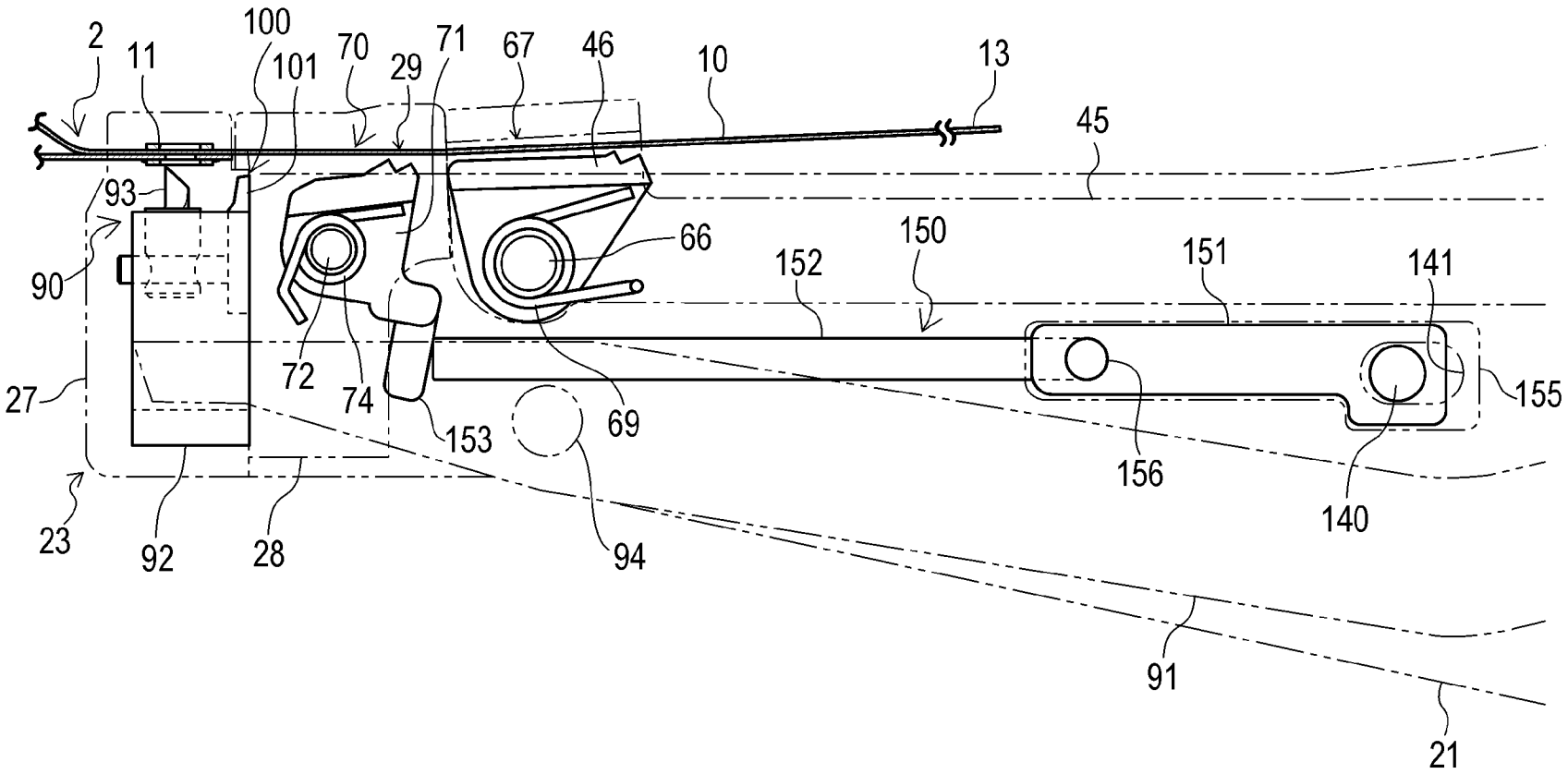
FIG. 22 is a side view showing the release mechanism shown in FIG. 20 in a second state.

Also, as shown in FIG. 22, the pushing body 152 is constituted to push the linked body 153 so that the return-stop chuck 71 rotates in the clockwise direction in FIG. 20 when the release mechanism 150 is operated to displace the release pin 140 to the release operating position. For that reason, at that time, the release mechanism 150 changes to a state to release the front path 29 so that the leading end portion 13 side of the band unit 10 can move.

When the operation of the release pin 140 ends, the release pin 140 is moved to the rear direction in FIG. 22 by the force of the kick spring 74 to recover to the non-operating position. Also, the release pin 140 is disposed to project in a direction (left direction) that is different to the projecting direction of the trigger 30 to the frame 21 enough to circumvent maloperation as much as possible.

Therefore, when the leading end portion 13 side of the band unit 10 is held by the holding mechanism 70 with the head unit 11 of the binding band 2 set in the set unit 23 of the tool body 20, the leading end portion 13 side of the band unit 10 is freed from the holding mechanism 70 using the release mechanism 150, and it is possible to move in any direction (front or rear directions) to the tool body 20.

Therefore, when the tightening position by the binding band 2 is incorrect, or the target to be bound 3 is incomplete after the binding band 2 is mounted to the manual binding tool 1, the entire binding band 2 is removed from the manual binding tool 1, the leading end portion 13 side of the band unit 10 is moved to return to the head unit 11, and the work relating to the binding band 2 is easily, and quickly be redone.

I claim:

1. A manual binding tool configured to bind a target using a metal binding band equipped with a band-shaped band unit and a head unit disposed at a first end portion side of the band unit in a length direction, the manual binding tool comprising:

a tool body that includes a frame, a handle unit projecting from the frame, and a set unit continuously disposed on the frame, the set unit configured to set the head unit of the metal binding band;

a first operating tool displaceably disposed on the tool body to oppose the handle unit;

a tightening mechanism configured to pull a second end portion side of the band unit in the length direction, after the first end portion side of the band unit passes through the set unit to the head unit, according to a displacement operation of the first operating tool;

a holding mechanism that holds the first end portion side of the band unit pulled by the tightening mechanism to the tool body to prevent the first end portion side of the band unit from moving to return to a head unit side that is set in the set unit;

a switching lever linked to the first operating tool at a pivot point via a pivot pin and aligned lengthwise with the first operating tool when the switching lever is in a first switching-operation position and the first operating tool is in a non-operating position, the switching lever including:

an operating unit extending from the pivot point and outside of the frame; and at least one extension extending from the pivot point and inside of the frame in a direction opposite of the operating unit, the pivot point located at a first end of the at least one extension, the at least one extension including a second end that is opposite the first end and that includes a switching pin configured to engage the tightening mechanism;

a fastening mechanism configured to, using the head unit, fasten the first end portion side of the band unit in the length direction, while the first end portion side of the band unit passes through the set unit to the head unit, according to a displacement operation of the switching lever; and a cutting mechanism configured to cut the first end portion side of the band unit, after the first end portion side of the band unit passes through the head unit that is set in the set unit, according to the displacement operation of the switching lever, to be separated in the length direction of the band unit.

2. The manual binding tool according to claim 1, wherein the set unit is arranged at a leading end portion of the frame so as to be positioned at an opposite side of the frame from a projecting direction of the handle unit.

3. The manual binding tool according to claim 1, wherein the set unit is disposed on the tool body so that the first end portion side of the band unit, in the length direction after the first end portion side of the band unit passes through the set unit, is positioned at an opposing side of the frame from the handle unit.

4. The manual binding tool according to claim 1, wherein the set unit is detachably mounted to the frame.

5. The manual binding tool according to claim 1, wherein the switching lever is configured to switch a mechanism that operates in response to a displacement of the first operating tool, the mechanism switchable between the tightening mechanism, the fastening mechanism, and the cutting mechanism.

6. The manual binding tool according to claim 5, wherein the switching lever is configured to be:

gripped together with the handle unit and the first operating tool;

integrally displaced with the first operating tool, to maintain the first switching-operation position, relative to the tool body when the first operating tool is displaced from the non-operating position to an operating position; and displaced relative to the first operating tool, from the first switching-operation position to a second switching-operation position via the pivot pin when the first operating tool is in the non-operating position, to cause the switching pin to disengage from the tightening mechanism.

7. The manual binding tool according claim 5, wherein the tightening mechanism includes a recess configured to:

receive the switching pin; and lock the switching pin to disable switching by the switching lever during the displacement operation of the first operating tool to prevent unintentional displacement of the switching lever.

8. The manual binding tool according claim 6, wherein displacement of the switching lever from the first switching-operation position to the second switching-operation position causes the switching pin to lock with a punch lever of the fastening mechanism to enable operation of the fastening mechanism by the first operating tool.

9. The manual binding tool according to claim 8, wherein when operation of the switching lever ends, the switching lever is configured to be rotated based on a force from a kick spring to return from the second switching-operation position to the first switching-operation position.

10. The manual binding tool according claim 6, wherein the switching lever is held at the first switching-operation position by a force from a kick spring aligned with the pivot pin.

* * * * *